US010125468B2

(12) United States Patent
Henriquez

(10) Patent No.: US 10,125,468 B2
(45) Date of Patent: Nov. 13, 2018

(54) STAY-IN-PLACE FOOTING FORM ASSEMBLY AND METHOD OF USE

(71) Applicant: Jose L. Henriquez, Maitland, FL (US)

(72) Inventor: Jose L. Henriquez, Maitland, FL (US)

( * ) Notice: Subject to any disclaimer, the term of this patent is extended or adjusted under 35 U.S.C. 154(b) by 0 days.

(21) Appl. No.: 15/412,207

(22) Filed: Jan. 23, 2017

(65) Prior Publication Data

US 2018/0209115 A1 Jul. 26, 2018

(51) Int. Cl.
*E02D 27/01* (2006.01)
*E04G 17/075* (2006.01)
*E04B 2/86* (2006.01)

(52) U.S. Cl.
CPC ..... *E02D 27/013* (2013.01); *E04B 2/86* (2013.01); *E04G 17/0758* (2013.01); *E02D 2200/1628* (2013.01); *E02D 2200/1678* (2013.01); *E02D 2250/0007* (2013.01); *E02D 2250/0023* (2013.01); *E02D 2300/002* (2013.01); *E02D 2300/0046* (2013.01); *E02D 2600/30* (2013.01)

(58) Field of Classification Search
CPC ..... E02D 27/013; E02D 2300/002; E02D 2250/0023; E02D 2600/30; E02D 2200/1678; E02D 2300/0046; E02D 2250/0007; E02D 2200/1628; E04B 2/86; E04B 2/8652; E04B 2002/867; E04B 1/16; E04G 17/0758; E04G 17/0754; E04G 17/12; E04G 17/14; E01C 19/506; E01C 19/502; E01C 19/50
USPC ..... 52/592.6, 424, 442, 426, 591.3, 592.2, 52/591.2, 592.1, 592.3, 309.2, 309.11, 52/309.12, 699, 741.13, 742.14; 249/2, 3, 249/4, 5, 6, 7, 34, 213, 216, 218
See application file for complete search history.

(56) References Cited

U.S. PATENT DOCUMENTS 972,036 A * 10/1910 Sullivan ..... B29C 33/3842 249/20
1,035,206 A * 8/1912 Lewen ..... 52/422
3,722,849 A * 3/1973 Luyben ..... E04G 13/00 249/219.1
4,291,858 A * 9/1981 NeSmith ..... E04G 17/0754 249/216

(Continued)

*Primary Examiner* — Robert Canfield
*Assistant Examiner* — Matthew J Gitlin
(74) *Attorney, Agent, or Firm* — CUSPA Technology Law Associates; Yi Li

(57) ABSTRACT

A stay-in-place footing form assembly includes a plurality of inner form boards serially aligned and joined by inner joining brackets, a plurality of outer form boards serially aligned and joined by outer joining brackets, a plurality of lower spacing rails, each disposed between and connecting base brackets in the inner and outer joining brackets aligned laterally, and a plurality of upper spacing rails, each disposed between and connecting top brackets in the inner and outer joining brackets aligned laterally. The lower spacing rails include first rebar receptacle(s) for seating horizontal rebars on the rails, and the upper spacing rails include second rebar receptacle(s) for holding vertical dowel rebars therein. The inner and outer form boards are insulation boards that have an ability of absorbing lateral forces of earthquakes exerted to a concrete footing formed in the stay-in-place footing form, and an ability of insulating the concrete footing from surrounding temperatures.

27 Claims, 28 Drawing Sheets

(56) References Cited

U.S. PATENT DOCUMENTS

| | | | | | |
|---|---|---|---|---|---|
| 4,916,879 | A * | 4/1990 | Boeshart | E04B 2/8652 | 249/40 |
| 5,649,401 | A * | 7/1997 | Harrington, Jr. | E04B 2/8652 | 249/194 |
| 5,809,726 | A * | 9/1998 | Spude | E02D 27/02 | 52/274 |
| 5,992,114 | A * | 11/1999 | Zelinsky | E04B 2/8652 | 249/216 |
| 6,250,033 | B1 * | 6/2001 | Zelinsky | E04B 2/8652 | 52/268 |
| 6,352,237 | B1 * | 3/2002 | Severino | E04B 2/8652 | 249/194 |
| 6,698,710 | B1 * | 3/2004 | VanderWerf | E02D 27/02 | 249/159 |
| 7,444,789 | B1 * | 11/2008 | Moore | E02D 27/02 | 249/33 |
| 8,231,100 | B2 * | 7/2012 | Boese | E04B 1/16 | 249/216 |
| 8,348,224 | B2 * | 1/2013 | McDonagh | E04G 11/085 | 249/216 |
| 2001/0029717 | A1 * | 10/2001 | Spakousky | E04B 2/8617 | 52/405.4 |
| 2006/0185293 | A1 * | 8/2006 | Metcalf | E02D 27/02 | 52/426 |
| 2006/0260239 | A1 * | 11/2006 | Boese | E04G 13/00 | 52/426 |
| 2009/0179135 | A1 * | 7/2009 | Amend | E04B 2/8641 | 249/33 |
| 2010/0064615 | A1 * | 3/2010 | Boese | E04G 13/00 | 52/426 |
| 2015/0082736 | A1 * | 3/2015 | Kang | E04B 2/86 | 52/656.9 |
| 2016/0281355 | A1 * | 9/2016 | McDonagh | E04B 2/02 | |

* cited by examiner

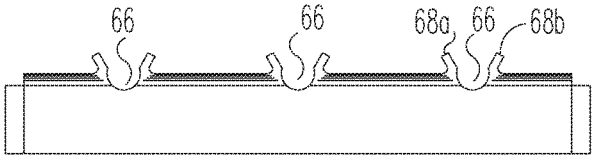
Fig. 5B
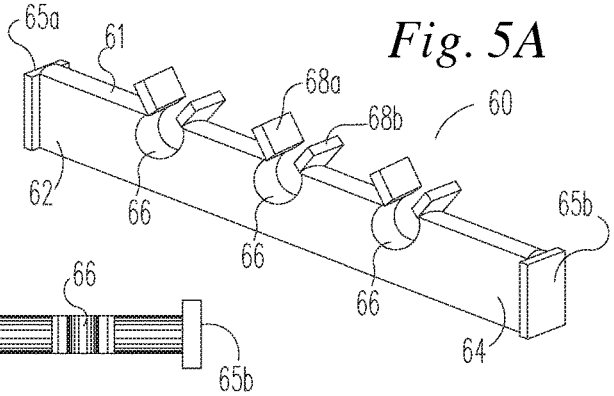
Fig. 5A
Fig. 5C
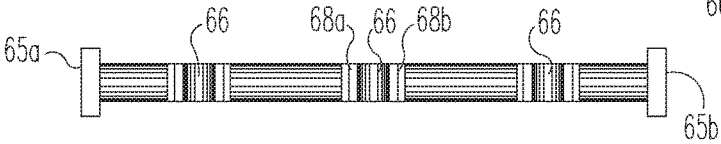
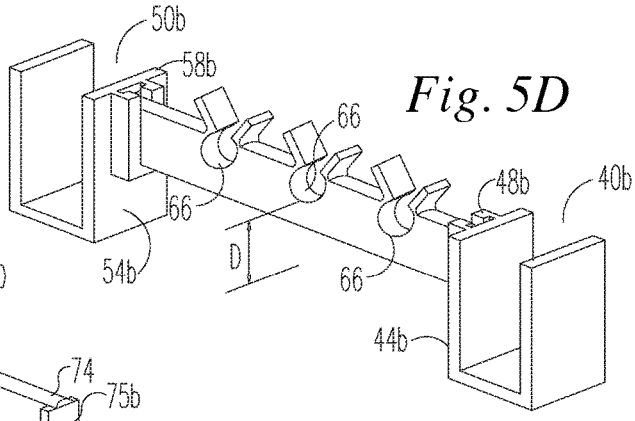
Fig. 5D
Fig. 6A
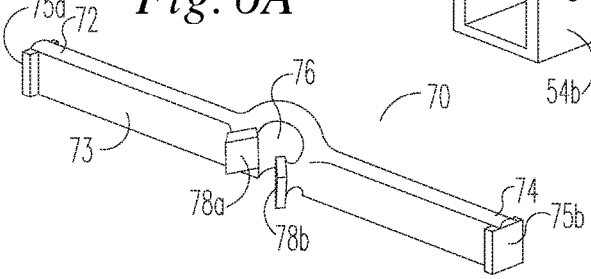
Fig. 6B
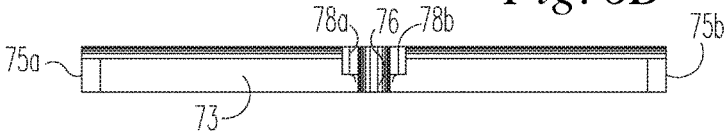
Fig. 6C
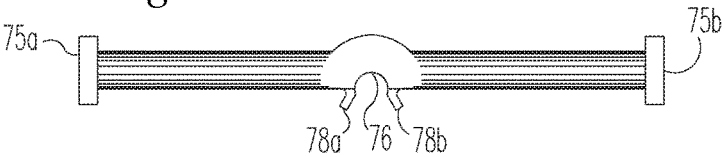

*Fig. 8B*
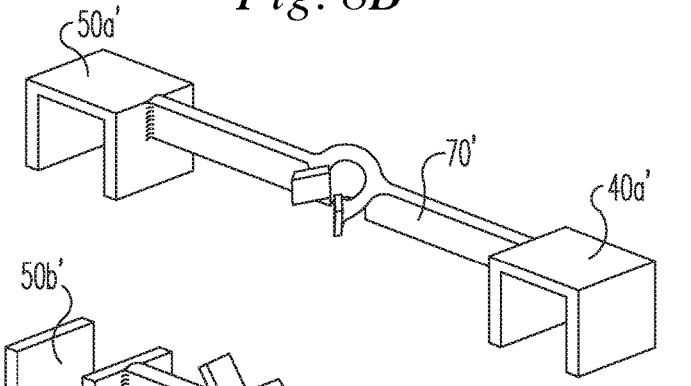
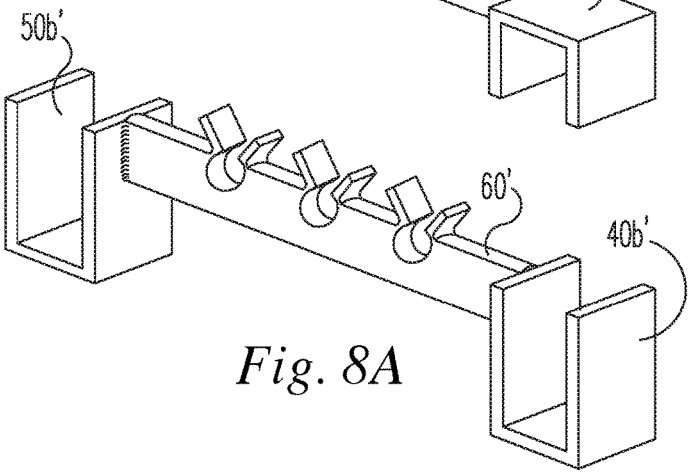
*Fig. 8A*
*Fig. 13*
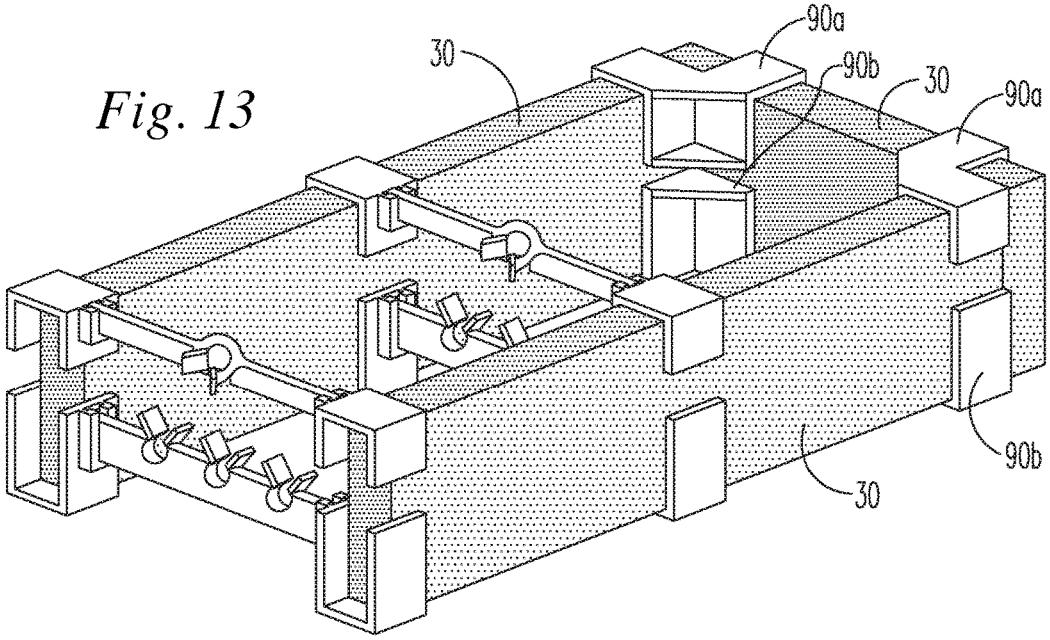

*Fig. 19E*
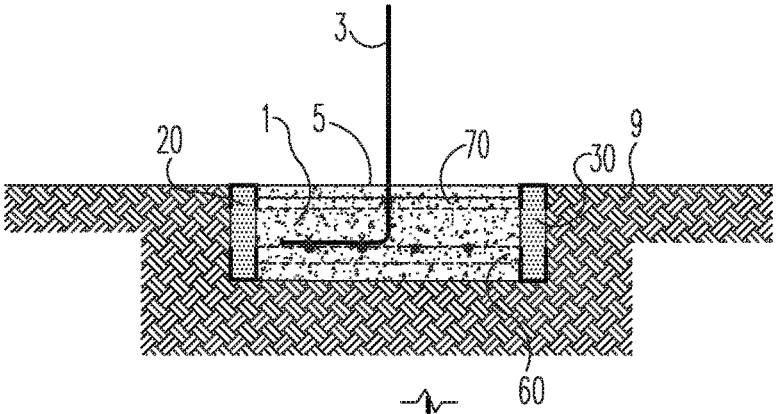
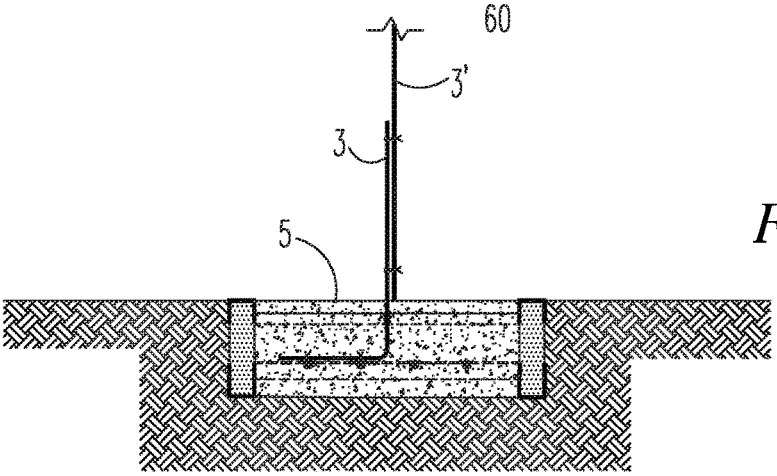
*Fig. 19F*
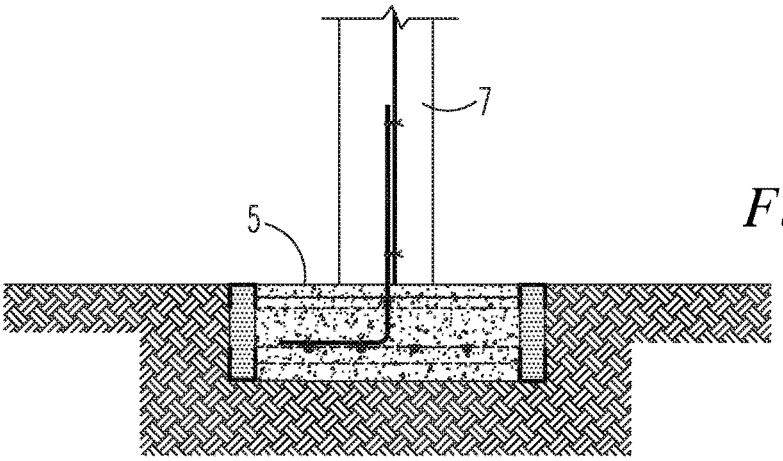
*Fig. 19G*

*Fig. 19H*
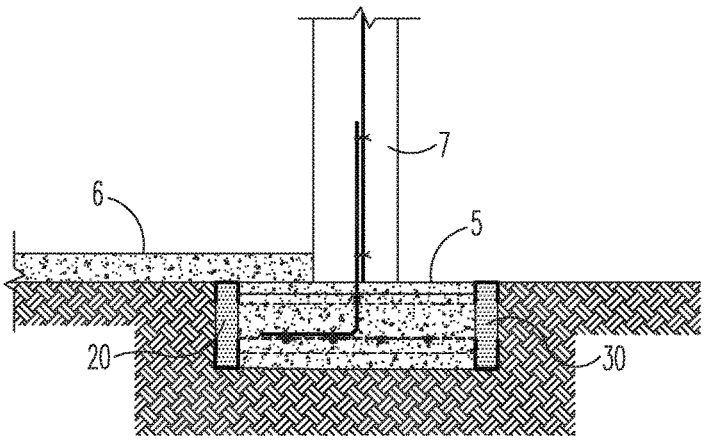
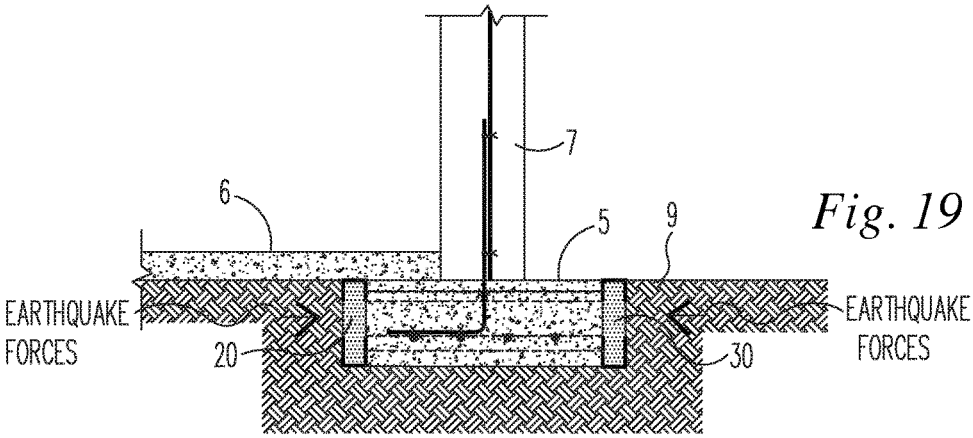
*Fig. 19 I*

*Fig. 20E*
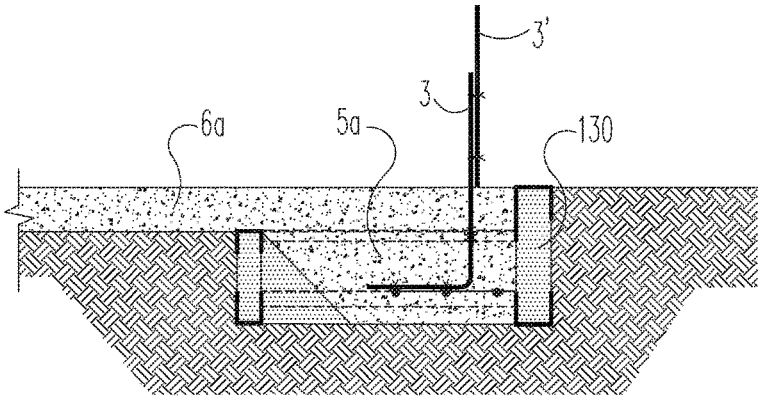
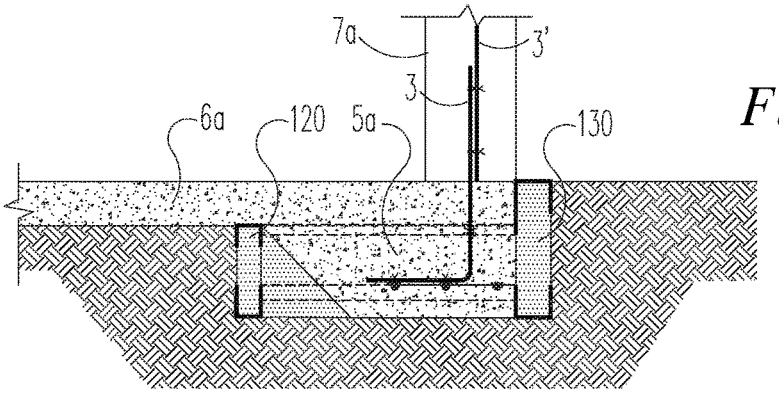
*Fig. 20F*
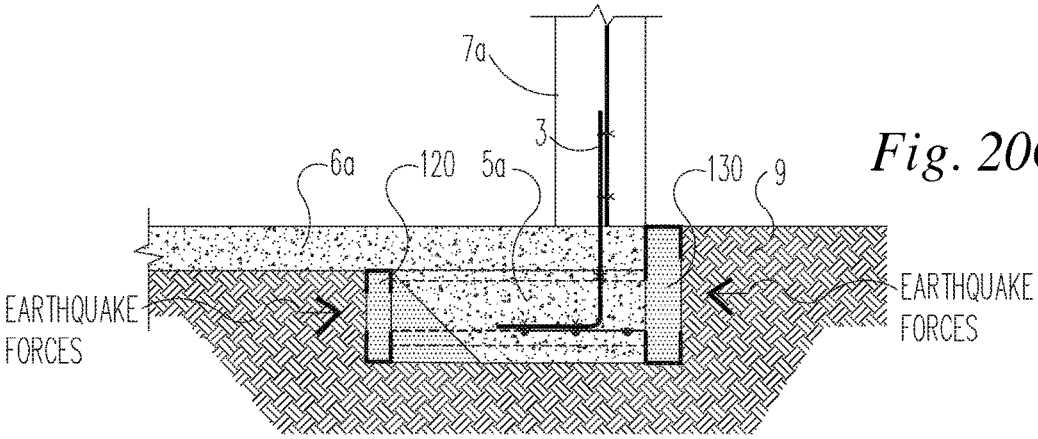
*Fig. 20G*

*Fig. 21A*
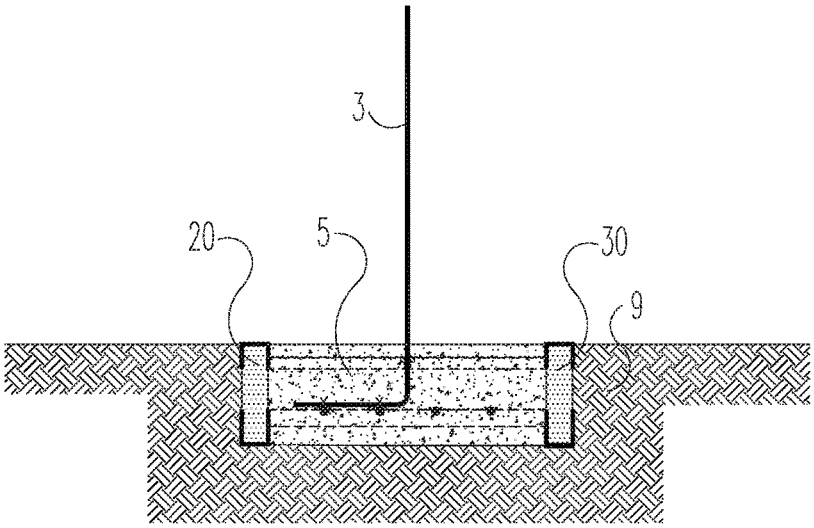
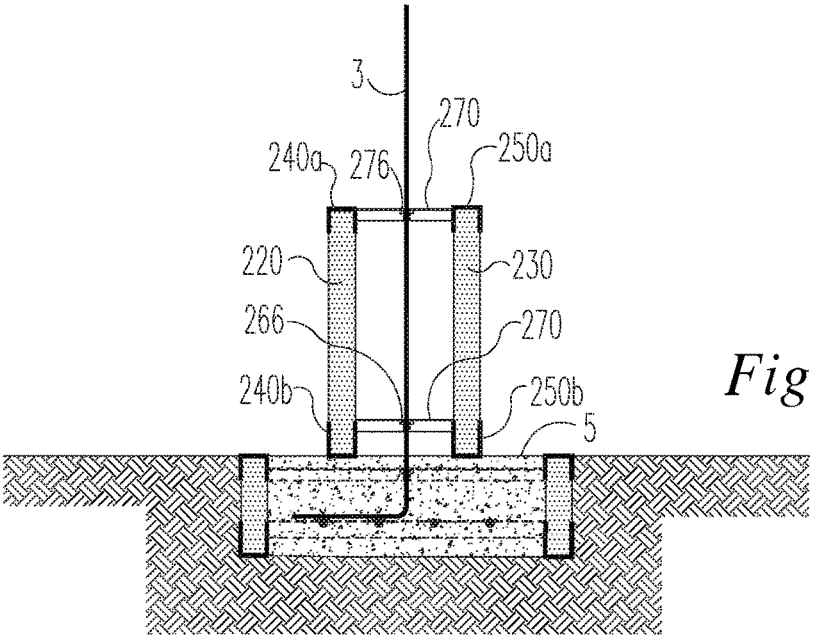
*Fig. 21B*

*Fig. 21C*
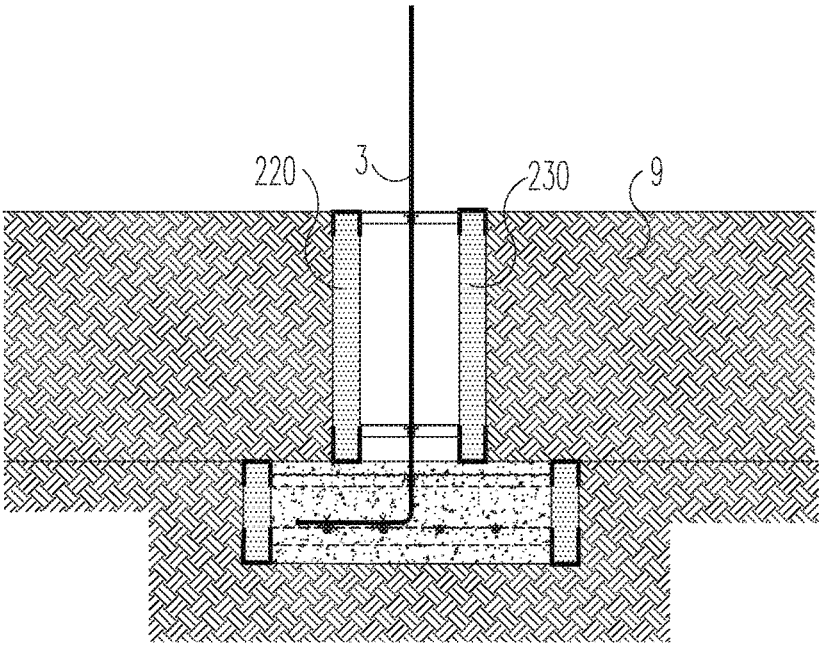
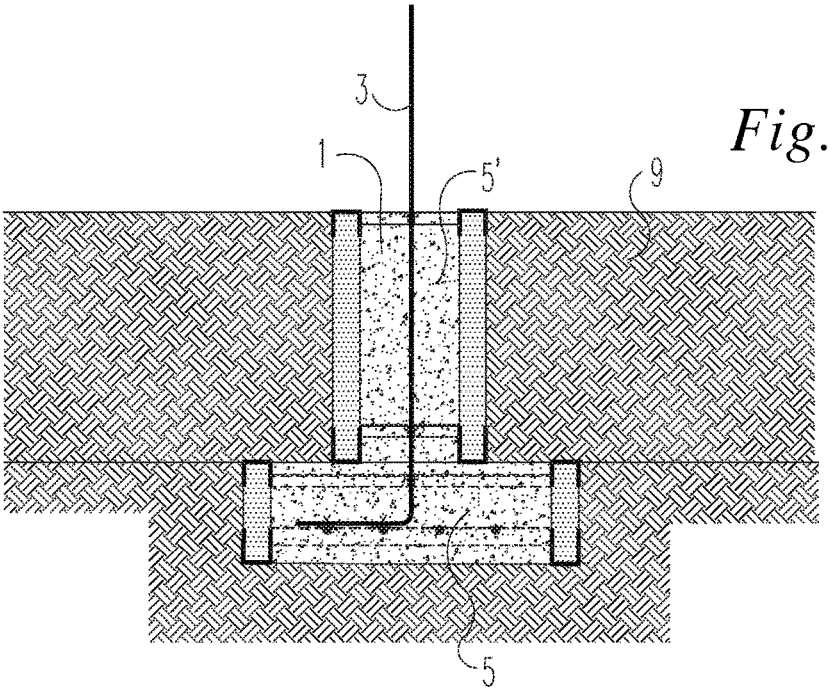
*Fig. 21D*

*Fig. 21E*
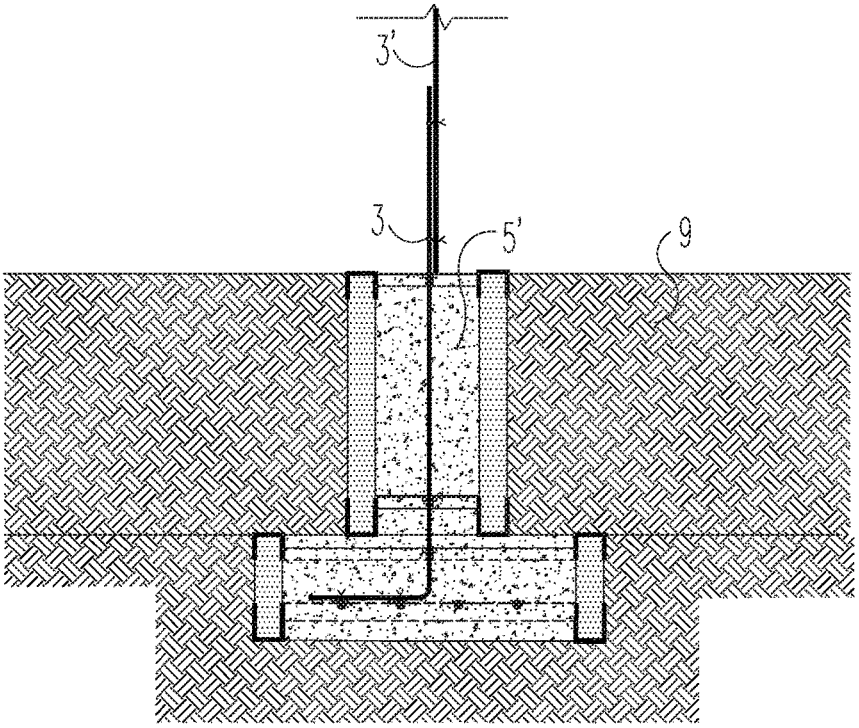
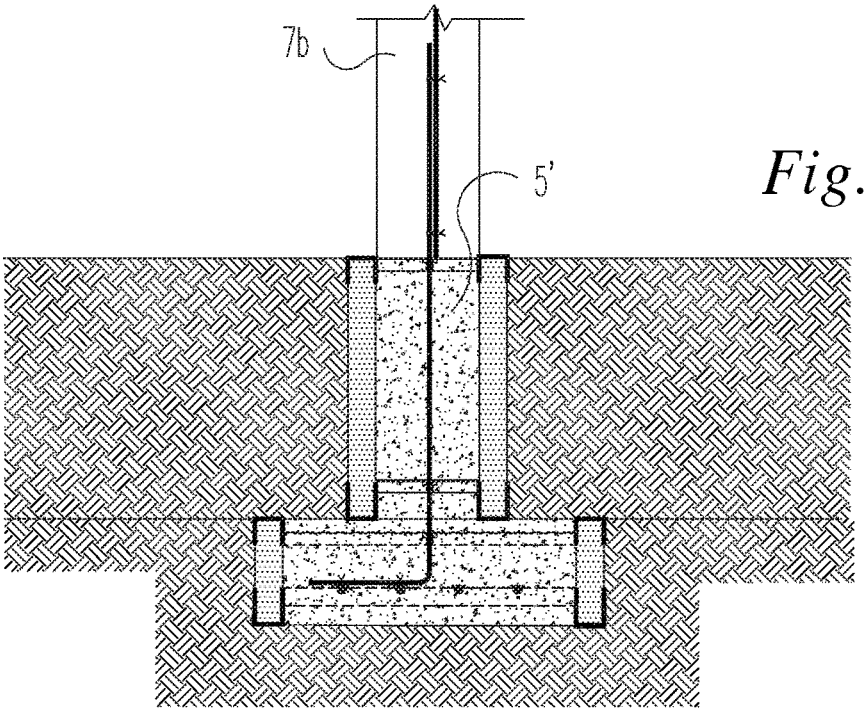
*Fig. 21F*

STAY-IN-PLACE FOOTING FORM ASSEMBLY AND METHOD OF USE

FIELD OF THE INVENTION

The present invention relates to footing forms, and more specifically, to a stay-in-place footing form assembly for concrete footings and a method of use thereof for constructing concrete footings.

BACKGROUND OF THE INVENTION

The footings for building structures are conventionally prepared by digging trenches in accordance with the architectural and structural design of the building, constructing temporary frameworks for the footing in the trenches, installing temporary rebar supports and installing rebars in the frameworks, pouring concrete paste into the space formed by the frameworks, removing the frameworks before the concrete is fully cured, and refilling the trench with soil after the frameworks are removed and the concrete footing is fully cured. This is a labor intensive and time consuming process.

Recently, prefabricated concrete forms have been developed for stay-in-place with the concrete footing formed, which eliminates the step of removing the temporary frameworks before the concrete is fully cured. However, moving and assembling concrete forms require heavy equipment and extensive physical labor. Further, alignment and support of the heavy concrete forms are difficult, which tends to cause irregularity and deformation of the footing.

Other types of stay-in-place footing frameworks include a prefabricated frame configured for the width of the footing with form board built in or installed at the job site prior to placing in the trenches. Such frameworks are prefabricated for the dimensions of the footing, and are not versatile for different construction needs. Further, installation of rebars in such frameworks may be difficult or inconvenient due to fixed structure of the frameworks.

Moreover, the existing concrete footings, such as concrete spread footing, monolithic concrete footings and concrete stem wall footings, are not resistant to impact forces from earthquakes. In the regions where earthquakes are a major threat to housings and human life, such as in California, Japan, Italy, Chili, and several regions in China, the existing concrete footings as the foundation of housings do not have protections from a direct impact force from earthquakes and are vulnerable to such an impact.

Therefore, there is a strong need for an improved stay-in-place footing form, which are easy to assemble at construction sites and versatile for different footing construction needs, and are able to substantially save time and labor cost of concrete footing constructions. Moreover, there is a strong need for a stay-in-place footing form, as an integral part of a concrete footing, has an ability of absorbing direct impact forces exerted by earthquakes to the concrete footing and hence reducing overall impacts and potential damages to the building structure.

SUMMARY OF THE INVENTION

In one aspect, the present invention is directed to a stay-in-place footing form assembly, which includes a plurality of inner form boards, each having a top, a bottom and a first end section and an opposing second end section, the inner form boards aligned in series with the first end section and the second end section of two immediately adjacent inner form boards against each other; a plurality of outer form boards, each having a top, a bottom and a first end section and an opposing second end section, the outer form boards aligned in series with the first end section and the second end section of two immediately adjacent outer form boards against each other; a plurality of pairs of inner joining brackets, each pair comprising a top bracket and a base bracket structurally independent of each other, the top bracket having an open lower end and the base bracket having an open upper end, and each top and base bracket having two opposing flanges with an inner width in mating relationship with a predetermined thickness of the first and second end sections of the inner form boards; the inner joining brackets joining the top and the bottom, respectively, of two inner form boards at an interface between the two inner form boards; a plurality of pairs of outer joining brackets, each pair comprising a top bracket and a base bracket structurally independent of each other, the top bracket having an open lower end and the base bracket having an open upper end, and each top and base bracket having two opposing flanges with an outer width in mating relationship with a predetermined thickness of the first and second end sections of the outer form boards; the outer joining brackets joining the top and the bottom, respectively, of two outer form boards at an interface between the two outer form boards; a plurality of lower spacing rails with a predetermined length, each lower spacing rail disposed between and connecting the base brackets in the inner and outer joining brackets aligned laterally, and each lower spacing rail comprising one or more first rebar receptacles; and a plurality of upper spacing rails with a predetermined length, each upper spacing rail disposed between and connecting the top brackets in the inner and outer joining brackets aligned laterally, and each upper spacing rail comprising one or more second rebar receptacles.

In some embodiments, the stay-in-place footing form assembly further includes a stay-in-place stem wall footing form subassembly. The stem wall footing form subassembly comprises a plurality of inner stem wall form boards, each having a top, a bottom and a first end section and an opposing second end section, the inner stem wall form boards aligned in series with the first end section and the second end section of two immediately adjacent inner stem wall form boards against each other; a plurality of outer stem wall form boards, each having a top, a bottom and a first end section and an opposing second end section, the outer stem wall form boards aligned in series with the first end section and the second end section of two immediately adjacent outer stem wall form boards against each other; a plurality of pairs of inner stem wall joining brackets, each pair comprising a top bracket and a base bracket structurally independent of each other, the top bracket having an open lower end and the base bracket having an open upper end, and each top and base bracket having two opposing flanges with an inner width in mating relationship with a predetermined thickness of the inner stem wall form boards; the inner stem wall joining brackets joining the top and the bottom, respectively, of two inner stem wall form boards at an interface between the two inner stem wall form boards; a plurality of pairs of outer stem wall joining brackets, each pair comprising a top bracket and a base bracket structurally independent of each other, the top bracket having an open lower end and the base bracket having an open upper end, and each top and base bracket having two opposing flanges with an inner width in mating relationship with a predetermined thickness of the outer stem wall form boards; the outer stem wall joining brackets joining the top and the bottom, respectively, of two outer stem wall form boards at an interface between the two outer stem wall form boards; and a plurality of upper and lower stem wall spacing rails with a predetermined length, disposed between and connecting the top and the base brackets, respectively, of the inner and outer stem wall joining brackets aligned laterally, and each upper and lower spacing rail comprising one or more vertical rebar receptacles.

In a further aspect, the present invention is directed to a method of constructing a concrete footing using the stay-in-place footing form assembly. The method includes in a trench excavated for the concrete footing, joining the inner form boards in series using the plurality of the inner joining brackets, joining the plurality of outer form boards in series using the outer joining brackets, and connecting the lower spacing rails between the base brackets in the inner and outer joining brackets aligned laterally; placing a plurality of horizontal rebars into the first rebar receptacles on the lower spacing rails; connecting the upper spacing rails between the top brackets in the inner and outer joining brackets aligned laterally; placing a plurality of vertical dowel rebars into the second rebar receptacles of the upper spacing rails; repositioning soil to fill the trench around the stay-in-place footing form assembly; and pouring a concrete paste into the stay-in-place footing form assembly, and curing the concrete paste to form the concrete footing with the stay-in-place footing form assembly as an integral part of the concrete footing.

In further embodiments, the method further includes constructing a stem wall footing using the stay-in-place stem wall footing form subassembly. The method includes constructing the stay-in-place stem wall footing form subassembly described above on the concrete footing; placing each of the vertical dowel rebars extending from the concrete footing into corresponding vertical rebar receptacles of the upper and lower stem wall spacing rails; and pouring a concrete paste into the stay-in-place stem wall footing form subassembly, and curing the concrete paste to form the stem wall footing with the stay-in-place stem wall footing form subassembly as an integral part of the stem wall footing.

The advantages of the present invention will become apparent from the following description taken in conjunction with the accompanying drawings showing exemplary embodiments of the invention.

BRIEF DESCRIPTION OF THE DRAWINGS

FIGS. 5A, 5B and 5C are a perspective view, a front view, and a top view, respectively, of a lower spacing rail in some embodiments. FIG. 5D illustrates the lower spacing rail installed in two base brackets.

FIGS. 6A, 6B and 6C are a perspective view, a front view, and a top view, respectively, of an upper spacing rail in some embodiments.

FIGS. 8A and 8B are perspective views of two base brackets integrally connected with a lower spacing rail, and two top brackets integrally connected with an upper spacing rail, respectively, in an alternative embodiment.

FIG. 13 shows a dead end section in the stay-in-place footing form assembly.

FIGS. 19A-19H illustrate schematically a process of constructing a concrete spread footing using the stay-in-place footing form assembly in one embodiment of the present invention. FIG. 19I further illustrates a built-in resistance to earthquake forces in an integral concrete footing formed with such a stay-in-place footing form assembly.

FIGS. 20A-20F illustrate schematically a process of constructing a concrete monolithic footing using the stay-in-place footing form assembly in another embodiment of the present invention. FIG. 20G further illustrates a built-in resistance to earthquake forces in an integral concrete footing formed with such a stay-in-place footing form assembly.

FIGS. 21A-21G illustrate schematically a process of constructing a concrete stem wall footing using the stay-in-place stem wall footing form subassembly in a further embodiment of the present invention.

It is noted that in the drawings like numerals refer to like components.

DETAILED DESCRIPTION OF THE INVENTION

Figure 1A:
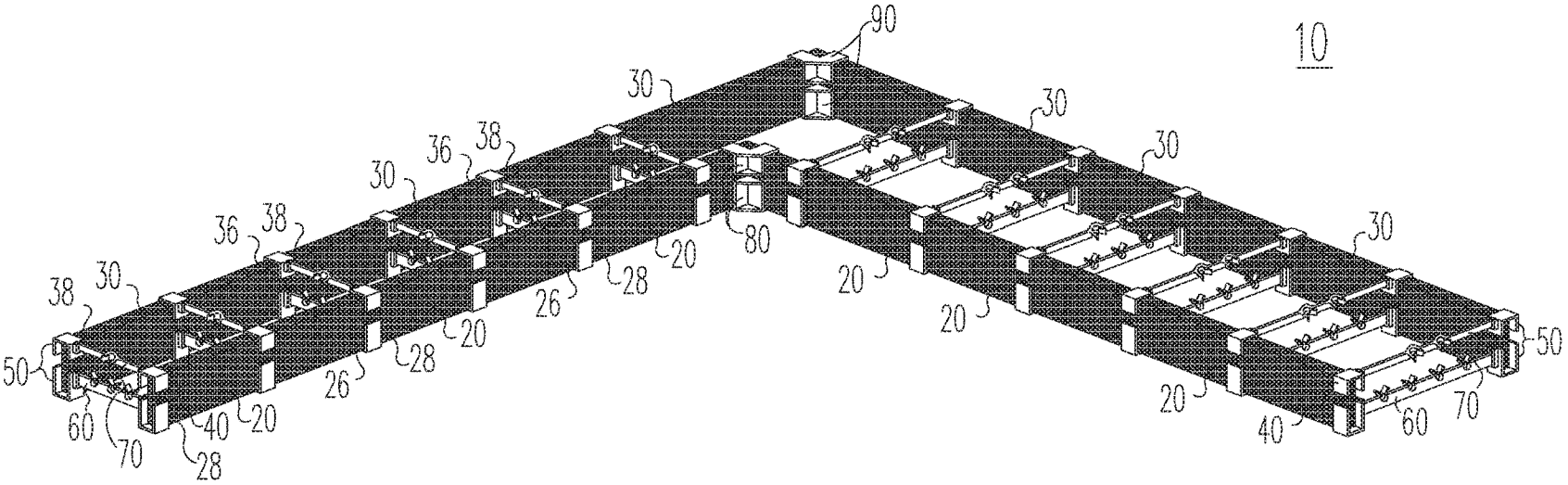
FIG. 1A is a perspective view of a section of a stay-in-place footing form assembly in one embodiment of the present invention.

Embodiments of the present invention generally relate to a stay-in-place footing form assembly for a concrete footing. The stay-in-place footing form assembly are manufactured into individual components and are connected together in an excavation as a footing form for a concrete footing, wherein the footing form remain permanently with the concrete and become an integral part of the concrete footing. Embodiments of the invention are described more fully hereinafter with reference to the accompanying drawings. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art. Elements that are identified using the same or similar reference characters refer to the same or similar elements.

Referring now to the drawings, FIG. 1A shows a section of a stay-in-place footing form assembly 10 in some embodiments of the present invention. As shown, the stay-in-place footing form assembly 10 comprises a plurality of inner form boards 20 joined serially by a plurality of pairs of inner joining brackets 40, a plurality of outer form boards 30 joined serially by a plurality of pairs of outer joining brackets 50, and a plurality of lower spacing rails 60 and upper spacing rails 70 disposed between and connecting corresponding inner and outer joining brackets 40 and 50.

Figure 1B:
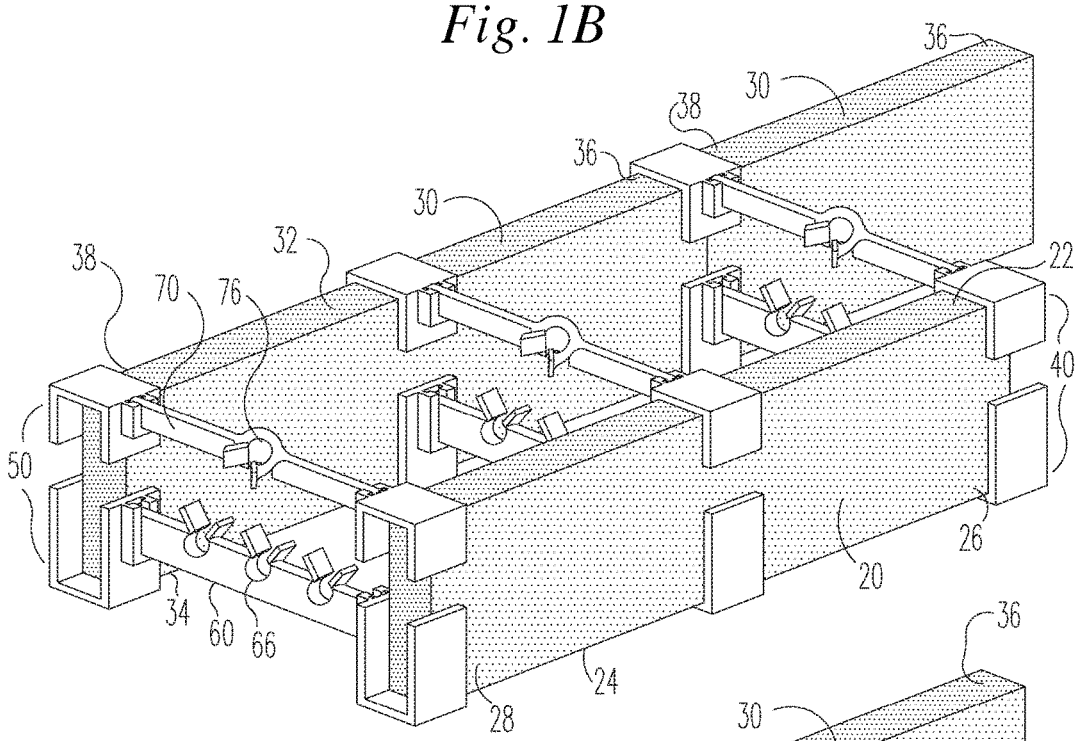
FIG. 1B is an enlarged perspective view of a portion of the stay-in-place footing form assembly shown in FIG. 1A.

FIG. 1B shows an enlarged view of a portion of the stay-in-place footing form assembly 10 shown in FIG. 1A. As shown, each inner form board 20 has a top 22, a bottom 24, a first end section 26 and an opposing second end section 28. The inner form boards 20 are aligned in series with the first end section 26 and the second end section 28 of two immediately adjacent inner form boards against each other, see FIG. 1A. Similarly, each outer form board 30 has a top 32, a bottom 34, a first end section 36 and an opposing second end section 38. The outer form boards 30 are aligned in series with the first end section 36 and the second end section 38 of two immediately adjacent outer form boards against each other.

Figures 2A, 2B, 2C, 3A, 3B, 3C, 4:
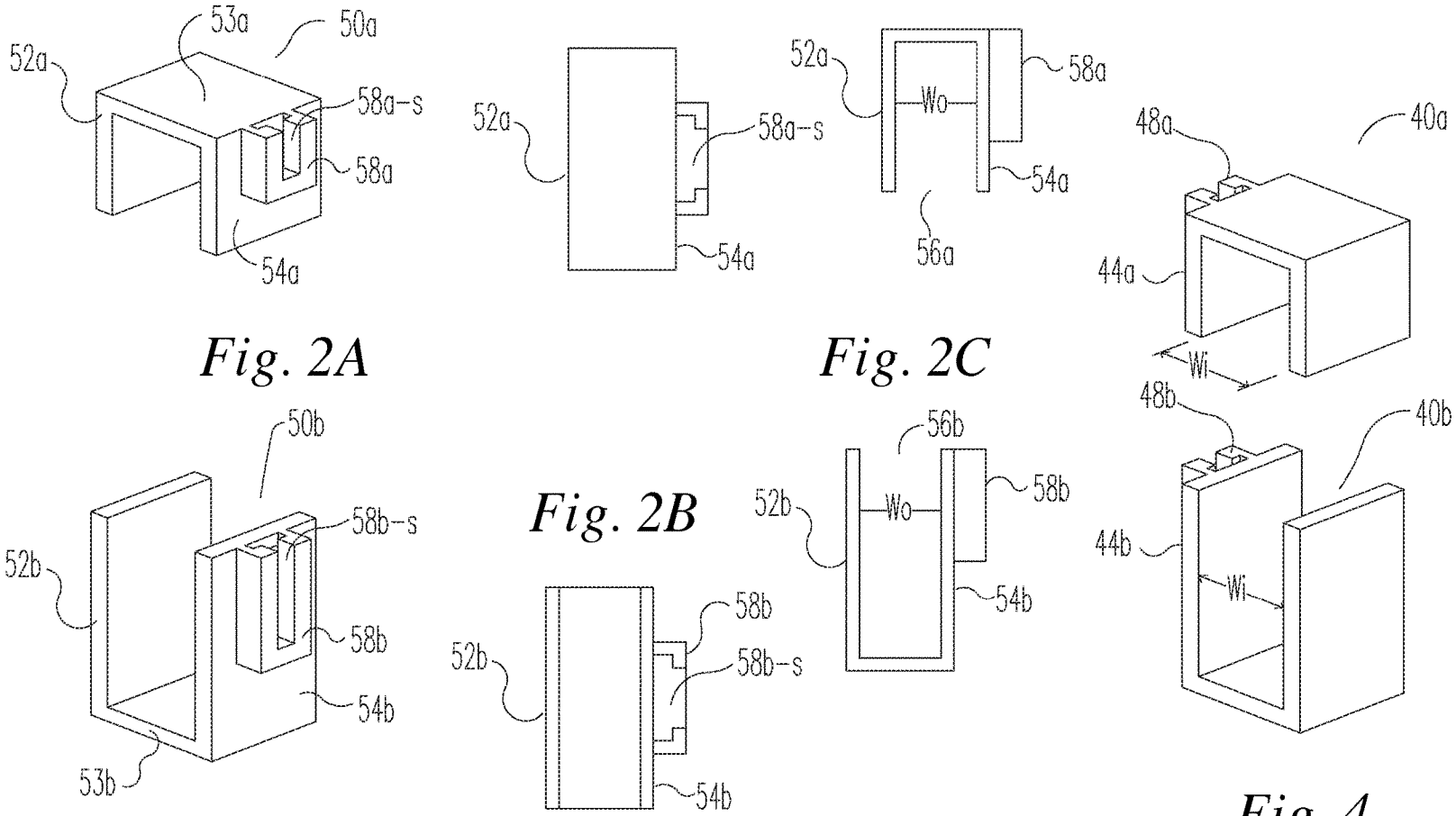
FIG. 2A is a perspective view of a base bracket in a pair of outer joining brackets in some embodiments.
FIGS. 2B and 2C are a top view and a side view of the base bracket, respectively.
FIG. 3A is a perspective view of a top bracket in a pair of outer joining brackets in some embodiments.
FIGS. 3B and 3C are a top view and a side view of the top bracket, respectively.
FIG. 4 is a perspective view of a top bracket and a base bracket in a pair of inner joining bracket.

Each pair of inner or outer joining brackets 40, 50 includes a top bracket and a base bracket. FIGS. 2A-2C show the structure of a base bracket 50*b* in a pair of outer joining brackets 50 in one embodiment. The base bracket 50*b* has two opposing flanges 52*b* and 54*b*, a bridge portion 53*b*, and an open upper end 56*b* (see FIG. 2C). Each base bracket 50*b* has an inner width $W_o$ in mating relationship with a predetermined thickness of the first and second end sections 36,38 of outer form boards 30.

As further shown in FIGS. 2A-2C, each base bracket 50*b* includes a rail receptacle 58*b* on the external side of one flange 54*b*, namely, the flange facing the spacing rails or the space between the inner and outer form boards. In the embodiment shown, rail receptacle 58*b* is in a form of a protruding element on the external side of flange 54*b*, which has a T-shaped slot 58*b-s* with an open top and a closed bottom. The front opening of the slot 58*b-s*, i.e., the bottom of the T, has a width complementary to the width of two opposing ends of lower spacing rail 60, and the height of the slot is comparable to the height of lower spacing rail 60. One end of a lower spacing rail 60 can be inserted into the rail receptacle 58*b* of a base bracket 50*b* through its open top and secured in the rail receptacle 58*b* without additional fixation means. Other suitable structures can also be used for the rail receptacle, for example, a slot having an opening on a side of the receptacle, or other suitable forms.

Moreover, the flanges 52*b* and 54*b* of base bracket 50*b* have a sufficient height to position the rail receptacle 58*b* at a height such that a desired distance between the lower spacing rail and the bottom of a trench for a concrete footing is ensured, as further described hereinafter.

FIGS. 3A-3C illustrate the structure of a top bracket 50*a* in a pair of outer joining brackets 50. As shown, top bracket 50*a* has two opposing flanges 52*a* and 54*a*, a bridge portion 53*a*, and an open lower end 56*a* (see FIG. 3C). Same as base bracket 50*b*, each top bracket 50*a* has an inner width $W_o$ in mating relationship with a predetermined thickness of the first and second end sections 36,38 of outer form boards 30. As further shown, each top bracket 50*a* includes a rail receptacle 58*a* on the external side of one flange 54*a*. In the embodiment shown, rail receptacle 58*a* has a similar structure of rail receptacle 58*b* of the base bracket 50*b*. The front opening of slot 58*a-s* in the rail receptacle 58*a* has a width complementary to the width of two opposing ends of upper spacing rail 70 and the height of slot 58*a-s* is comparable to the height of upper spacing rail 70.

FIG. 4 shows a top bracket 40*a* and a base bracket 40*b* in a pair of inner joining brackets 40. The top bracket 40*a* and base bracket 40*b* may have the same structure of top bracket 50*a* and base bracket 50*b* in the outer joining brackets 50 described above, except that the inner width $W_i$ between the two opposing flanges in the top and base brackets 40*a*, 40*b* is in mating relationship with a predetermined thickness of the first and second end sections 26,28 of inner form boards 20. Same as in outer joining brackets 50, each top bracket 40*a* in the inner joining brackets 40 has a rail receptacle 48*a* on the external side of one flange 44*a*, and each lower bracket 40*b* has a rail receptacle 48*b* on the external side of one flange 44*b*, i.e., the flanges facing the spacing rails or the space between the inner and outer form boards. In the embodiment shown, rail receptacles 48*a* and 48*b* have the same structures of rail receptacles 58*a* and 58*b* in the outer joining brackets 50 described above.

As can be appreciated, because of structural similarities between the inner and outer joining brackets, when the thickness of the inner and outer form boards is the same, the outer joining brackets 50 become same as the inner joining brackets 40. In other words, the top and base brackets 50*a*, 50*b* in a pair of outer joining brackets 50 can be simply reversed and used as the top and base brackets 40*a*, 40*b* of inner joining brackets 40. However, depending on a desired absorbing capacity to impact forces from earthquakes as described hereinafter, the thickness of the outer form boards may also be different from that of the inner form boards. In such a situation, the inner width $W_o$ between the two opposing flanges in the top and base brackets 50*a*, 50*b* in outer joining brackets 50 is different from the inner width $W_i$ in the inner joining brackets 40.

As illustrated in FIGS. 1A and 1B, a pair of inner joining brackets 40 joining the top and the bottom, respectively, of two inner form boards 20 at the interface between the first end section 26 and the second end section 28 of two immediately adjacent inner form boards 20. Similarly, a pair of outer joining brackets 50 joining the top and the bottom, respectively, of two inner form boards 30 at the interface between the first end section 36 and the second end section 38 of two immediately adjacent inner form boards 30.

FIGS. 5A-5C illustrate the structure of a lower spacing rail 60 in some embodiments. As shown in FIG. 5A, the lower spacing rail 60 has two opposing ends 62, 64 and a predetermined length according to the width of a concrete footing to be constructed. In the embodiment shown, lower spacing rail 60 has an end flange 65*a* and 65*b* at opposing ends 62, 64, respectively. As such, both ends of the lower spacing rail have a T-shaped profile, complementary to the T-shaped slot in the rail receptacles 48*b*, 58*b* of base brackets 40*b*, 50*b* for anchoring the lower spacing rail in the base brackets once both ends of the lower spacing rail are inserted into the two rail receptacles.

As further shown, each lower spacing rail 60 includes one or more first rebar receptacles 66. In the embodiment shown, the first rebar receptacle 66 is in a form of recess from the upper edge 61 of the lower spacing rail. The recess may assume a semi-circle, oval, or other suitable shapes that are complementary to horizontal reinforcement bars (rebars) used for constructing a concrete footing. Horizontal steel rebars commercially used in constructing concrete footings typically have a diameter from about ⅜ inch to about 1 inch, and a length from about 2 feet to about 40 feet. Optionally, the first rebar receptacle 66 further includes a pair of upper protrusions 68*a* and 68*b* extending radially outward from the recess, which provides an enlarged opening to the first rebar receptacle and facilitates placement of a horizontal rebar in the first rebar receptacle 66 during construction. The pair of upper protrusions 68*a* and 68*b* has a sufficient thickness and strength to withstand walking and standing thereupon by construction workers.

In the embodiment shown in FIGS. 5A-5C, the lower spacing rail 60 has a generally rectangular cross section and has a height to width ratio above 1.0. In some embodiments, the height of the lower spacing rail may be from about 2 to about 8 inches, which provides the strength to withhold the weight of horizontal steel rebars placed on the lower spacing rails, as well as to withstand potential walking and standing thereupon by construction workers during construction of the footing form assembly 10. In some embodiments, the height to width ratio may be from about 1.5:1 to about 10:1. Such a height to width ratio supports the strength of the rails, but not unnecessarily increases the material used for the rail.

Horizontal steel rebars or vertical dowel rebars used for concrete footings need to be separated from the soil in the trench to prevent corrosion over time. As shown in FIG. 5D, in footing form assembly 10 there is a minimum distance (D), in the vertical direction, of no less than 3 inches from the bottom of the first rebar receptacle 66 of the lower spacing rail 60 to the bottoms of base brackets 40*b* and 50*b*. The height of the flanges of brackets 40*b* and 50*b* and the position of the rail receptacle in brackets 40*b* and 50*b* can be constructed accordingly to achieve the above minimum distance (D) required in footing form assembly 10. As such, the rebars installed in the first rebar receptacle 66 of the lower spacing rail 60 are maintained at a sufficient height to prevent the rebars from contacting soil at the bottom of a trench used for the concrete footing.

FIGS. 6A-6C show the structure of an upper spacing rail 70 in some embodiments. As shown, the upper spacing rail 70 has two opposing ends 72, 74 and a predetermined length. In general, the length of upper spacing rail 70 is the same as that of lower spacing rail 60. Similar to the lower spacing rail, the upper spacing rail 70 has an end flange 75*a* and 75*b* at opposing ends 72, 74, respectively. The T-shaped profile is complementary to the T-shaped slot in the rail receptacles of top brackets 40*a*, 50*a* for anchoring the upper spacing rail 70 in place after the two ends of the upper spacing rail 70 are inserted into the top brackets. Other suitable configurations for securing or interlocking the spacing rails with the rail receptacles of respective top or base brackets may also be used.

As shown, each upper spacing rail 70 includes one or more second rebar receptacles 76. In the embodiment shown, the second rebar receptacle 76 is in a form of recess from a side 73 of the upper spacing rail. Optionally, the second rebar receptacle 76 further includes a pair of protrusions 78*a* and 78*b* which extend radially outward from the recess, which provides an enlarged opening to the second rebar receptacle and facilitates placement of a vertical dowel rebar in the second rebar receptacle 76 during construction. The recess may assume a semi-circle or other suitable shapes that are complementary to vertical dowel rebars used for constructing a concrete footing.

Different from lower spacing rails 60, which are structured to support the weight of horizontal steel rebars used for constructing a concrete footing, the upper spacing rails 70 may have a lesser height, and may also have a lesser width in comparison with the lower spacing rails described above. In some embodiments, the height of the upper spacing rail may be from about 1 to about 6 inches.

During construction, the two opposing ends of a lower spacing rail 60 are inserted into rail receptacles 48*b* and 58*b* of corresponding base brackets 40*b* and 50*b* of the inner joining brackets 40 and outer joining brackets 50, and the two opposing ends of an upper spacing rail 70 are inserted into rail receptacles 48*a* and 58*a* of corresponding top brackets 40*a* and 50*a* of the inner joining brackets 40 and outer joining brackets 50 at a construction site. Herein, corresponding base brackets or corresponding top brackets refer to the base brackets, or top brackets, of the inner joining brackets 40 and outer joining brackets 50 aligned in lateral direction. Once the lower and upper spacing rails are inserted into the receptacles of respective base and top brackets, they are locked in the receptacles. Due to the interlocking structure, no further affixation such as bolting, screwing or tying is needed. As shown in FIGS. 1A and 1B, lower spacing rails 60 and upper spacing rails 70 bridge the inner and outer form boards together through their connections with the inner joining brackets 40 and outer joining brackets 50. In addition to supporting horizontal and vertical dowel rebars, the lower and upper spacing rails provide supports to the assembled form boards against the soil that is refilled around the assembly in a trench in which the assembly 10 is installed for constructing a concrete footing.

Figure 1C:
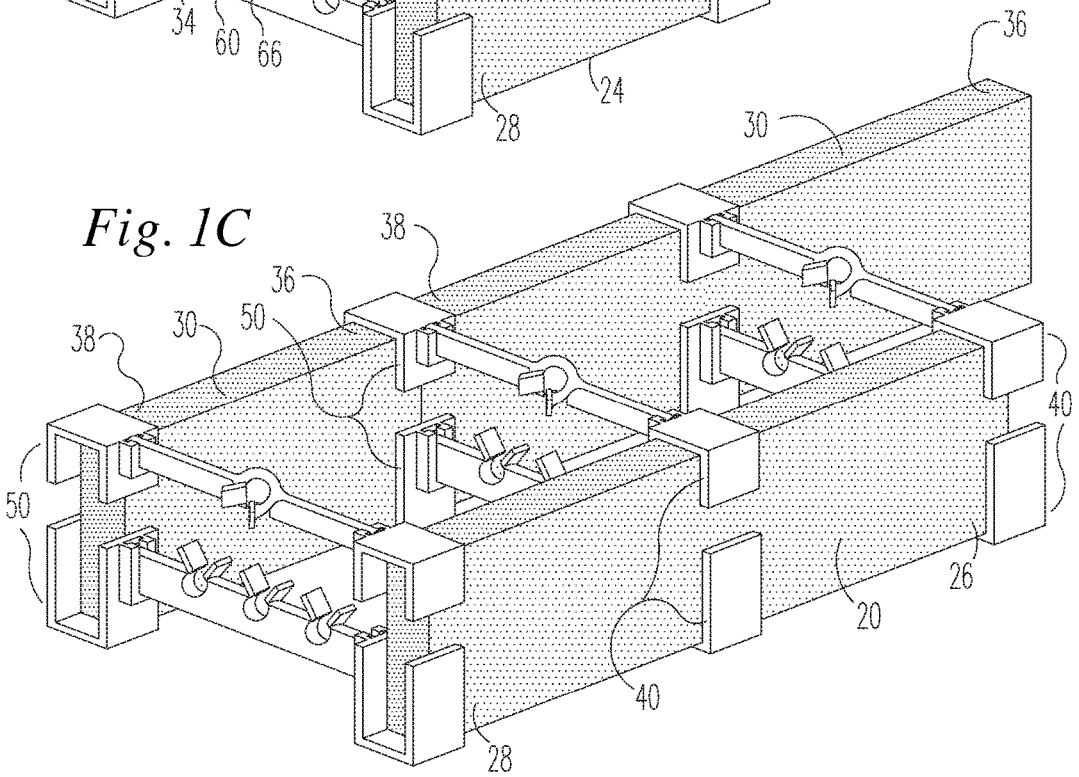
FIG. 1C illustrates an alternative inner form board arrangement in the same portion shown in FIG. 1B.

As further shown in FIG. 1C, the inner form boards 20 and outer form boards 30 may have a different length. As shown, a pair of outer joining brackets 50 are used to join two outer form boards 30 together, while the corresponding inner joining brackets 40 can be attached to the top and the bottom, respectively, at a middle portion of an inner form board 20, and then the lower and upper spacing rails 60, 70 can be connected to the inner joining brackets 40 and outer joining brackets 50 as described above. Similarly, a pair of inner joining brackets 40 can be used to join two inner form boards 20 together, while the corresponding outer joining brackets 50 can be attached to the top and the bottom, respectively, at a middle portion of an outer form board 30.

Moreover, as further shown in FIGS. 1A and 1B, additional pairs of inner joining brackets 40 and outer joining brackets 50 may be installed on the inner and outer form boards at a middle portion of the form boards or a point beyond the interface between two immediately adjacent form boards, and additional lower and upper spacing rails may then be installed between these additional inner and outer joining brackets 40, 50. This provides additional supporting structures for installing vertical dowel rebars, and provides a further structural strength in the assembly.

Figure 7:
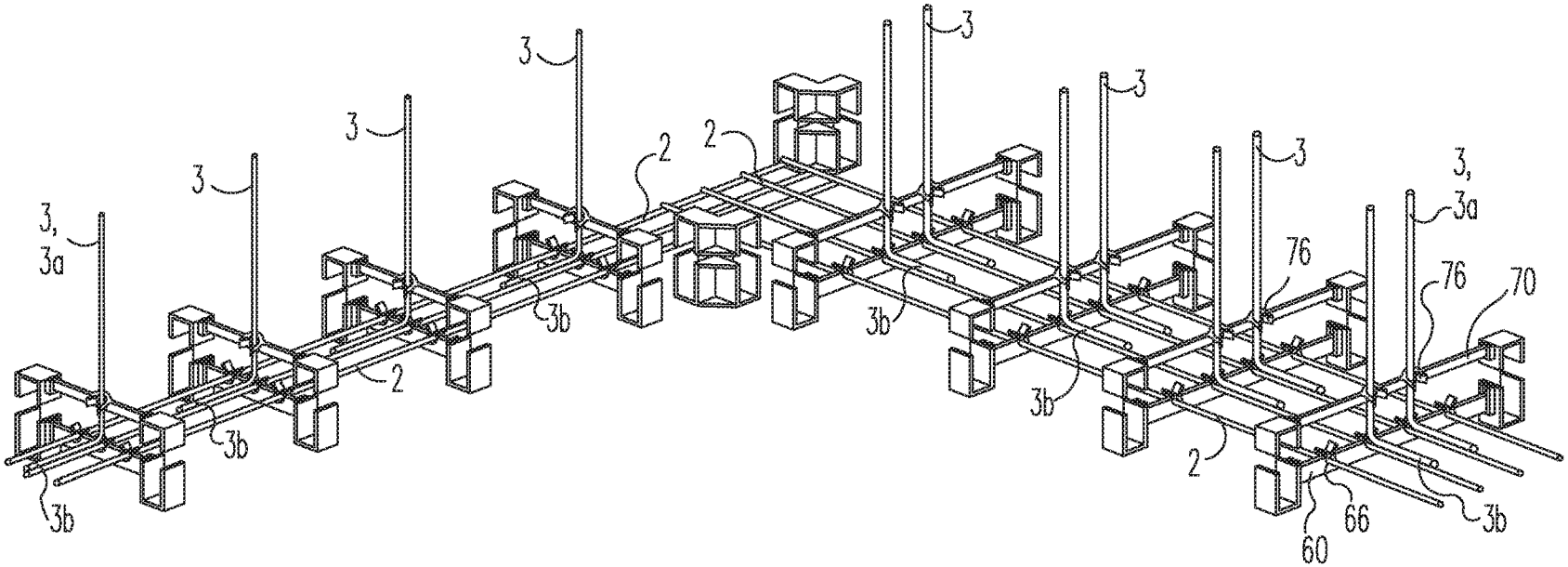
FIG. 7 is a perspective view of a portion of the stay-in-place footing form assembly shown in FIG. 1A, with horizontal and vertical dowel rebars installed in the footing form assembly, wherein the inner and outer form boards are removed for showing the positions of the horizontal and vertical dowel rebars in the footing form assembly.

FIG. 7 illustrates a section of stay-in-place footing form assembly 10 during construction of a concrete footing, in which the inner and outer form boards are removed to show more clearly the positions of the horizontal and vertical dowel rebars installed in the assembly 10. As shown, multiple horizontal steel rebars 2 have been laid in the first rebar receptacles 66 on the lower spacing rails 60 in the footing form assembly, and multiple vertical dowel rebars 3 have been placed in second rebar receptacles 76 of the upper spacing rails 70. With the footing form assembly 10, the horizontal rebars 2 laid in the first rebar receptacles 66 have a stable position and do not need to be secured with further fasten means. On the other hand, when a crossover of the horizontal rebars with one and another occurs, as shown in the corner of the assembly shown in FIG. 7, parts of horizontal rebars 2 can be lifted slightly from the bottom of the first rebar receptacles 66 to allow the end portion of these horizontal rebars 2 to be laid on top of other horizontal rebars while still maintaining the alignment of the horizontal rebars 2 in the footing form assembly 10. As further shown in FIG. 7, vertical dowel rebar 3 used in concrete footings is usually in a L-shape, which includes a vertical portion 3*a* and a horizontal portion 3*b*. As shown, in the footing form assembly 10, the horizontal portion 3*b* of a vertical dowel rebar 3 can be put on top of a horizontal rebar 2 and can be fastened thereto with fasten means, such as metal wires, pins, clips, existing rebar fasteners, and the like.

In the embodiment described above, separate structures of spacing rails from the inner and outer joining brackets simplify manufacturing and installation of the footing form assembly. For concrete footings of different widths, the same inner and outer joining brackets can be used for joining respective form boards regardless the footing width, and only different lengths of spacing rails 60, 70 are needed. On the other hand, as shown above the top and base brackets in the inner and outer joining brackets 40, 50 are structurally independent of each other. As such, the same pair of joining brackets (40 or 50) can be used with form boards of different heights. For example, for constructing concrete footings of different depths, the inner and outer form boards with heights comparable to the footing depths are required, however, the same inner and outer joining brackets 40, 50 can be used independent of the height of the form boards. In another instance, as described hereinafter, the inner form boards for a concrete spread footing and for a monolithic concrete footing of the same depth have different heights, however, the same pair of inner joining brackets 40 can be used for both types of footings. These separate structural components are versatile and offer a substantial flexibility in manufacturing and installation of the footing form assembly.

The inner and outer joining brackets 40, 50 and the lower and upper spacing rails 60, 70 may be made of plastics, wood, metal, rubber, fiberglass enforced polymer, carbon fiber reinforced polymer, fiber cement, basalt fiber composite, or other suitable materials. When a metal is used, preferably the metal is non-corrosive. Moreover, the inner and outer joining brackets can be made of a material different from that used for the spacing rails. In some embodiments, the joining brackets and spacing rails are made of plastics, such as polyvinyl chloride (PVC), polyethylene and polypropylene, by plastic molding.

Moreover, in an alternative embodiment, a lower spacing rail 60', a base bracket 40*b*' and a base bracket 50*b*' in inner joining brackets and outer joining brackets may be prefabricated as a single piece structure, as shown in FIG. 8A. Similarly, an upper spacing rail 70', a top bracket 40*a*' and a top bracket 50*b*' in inner joining brackets and outer joining brackets may be prefabricated as a single piece structure, as shown in FIG. 8B. With this integral structure, the inner and outer form boards 20, 30 can be inserted into the base bracket 40*b*' and 50*b*', respectively, at a construction site, and the top bracket 40*a*' and 50*b*' are inserted onto the top of the inner and outer form boards, respectively. As shown in FIGS. 8A-8B, in this configuration the top and base brackets do not have rail receptacles. Such an integral structure may be provided for those most common widths of concrete footings.

Figure 9:
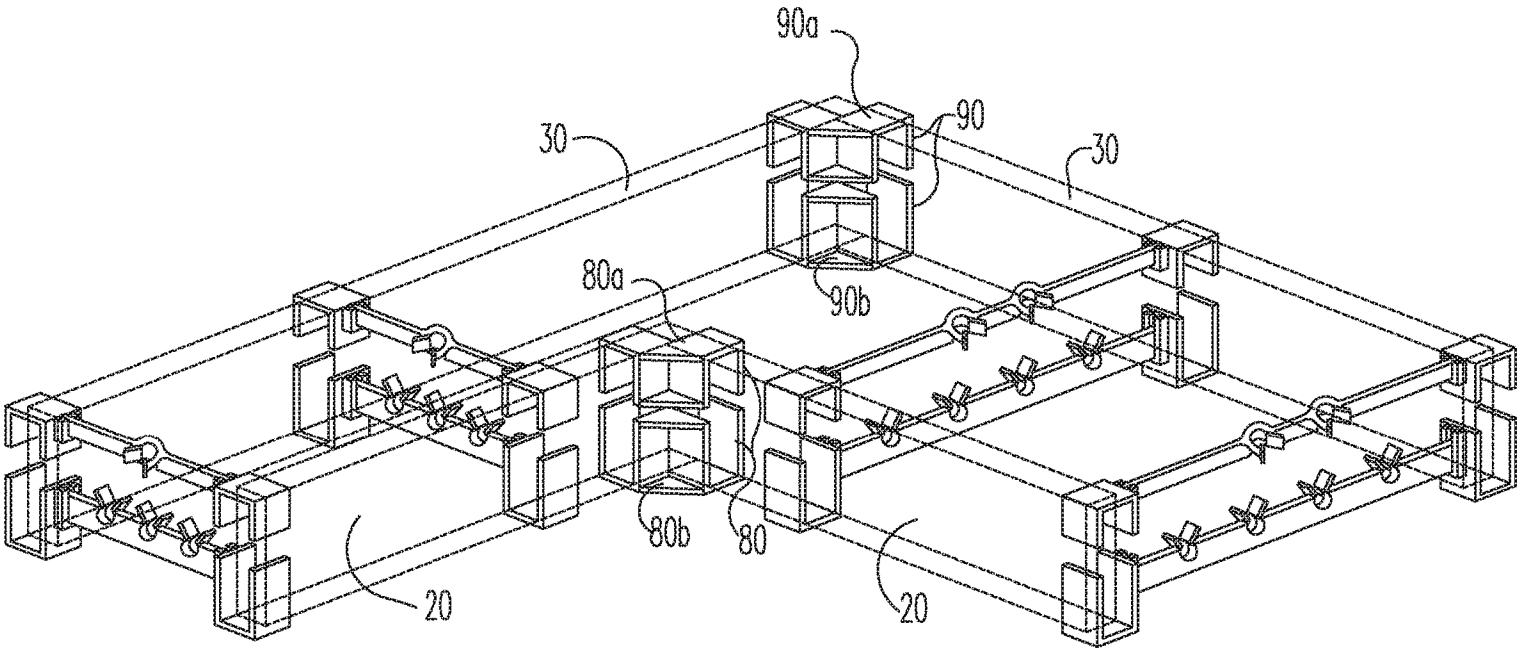
FIG. 9 is a perspective view of a corner section in the stay-in-place footing form assembly shown in FIG. 1A, with the inner and outer form boards in phantom.
Figure 10A:
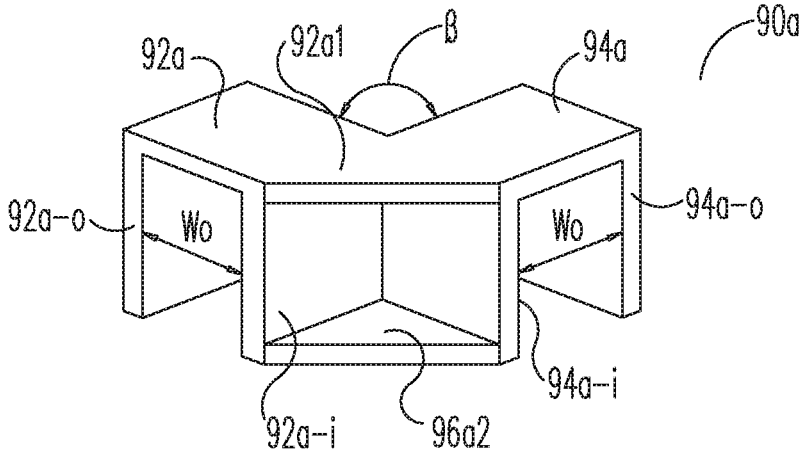
FIG. 10A is a perspective view of a top corner bracket in an outer corner anchor shown in FIG. 9.

In some embodiments, the footing form assembly 10 further includes a plurality of inner corner anchors 80 and outer corner anchors 90 for corner sections of the assembly, as shown in FIG. 9. Each corner anchor includes a top corner bracket and a base corner bracket. FIG. 10A shows the structure of a top corner bracket 90*a* in an outer corner anchor 90 in some embodiments. The top corner bracket 90*a* has a first bracket portion 92*a* and a second bracket portion 94*a* with an angle β between each other. The first bracket portion 92*a* has an inner flange 92*a-i* and an outer flange 92*a-o* with an inner width $W_o$ between the two flanges. The second bracket portion 94*a* has an inner flange 94*a-i* and an outer flange 94*a-o* with the inner width $W_o$ between the two flanges. The inner width $W_o$ is in mating relationship with the thickness of the first and second end sections 36, 38 of the outer form boards 30. The first bracket portion 92*a* and second bracket portion 94*a* are connected by a top bridging plate $\mathbf{96}a_1$ and a bottom bridging plate $\mathbf{96}a_2$. The angle β between bracket portion 92*a* and bracket portion 94*a* depends on the architecture design of a building. For most commonly seen buildings, angle β is 90 degrees. However, angle β can be either greater or less than 90 degrees.

Figure 10B:
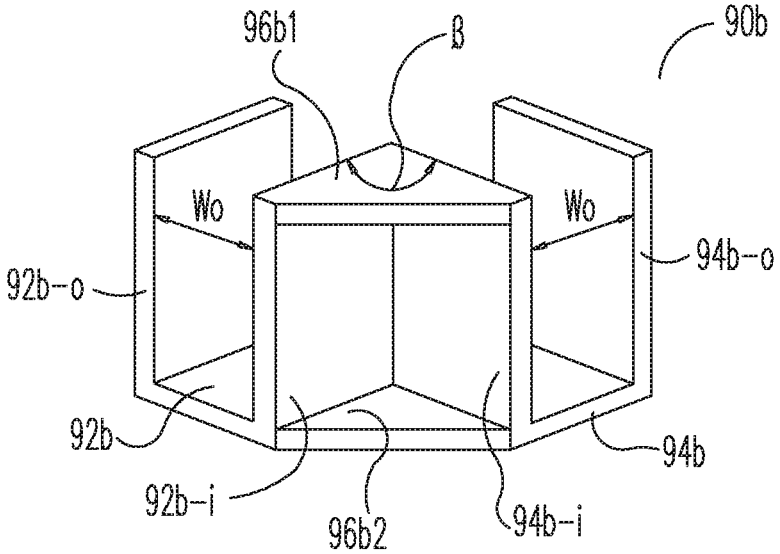
FIG. 10B is a perspective view of a base corner bracket in the outer corner anchor.

FIG. 10B shows the structure of a base corner bracket 90*b* in an outer corner anchor 90. Similar to the top corner bracket, each base corner bracket 90*b* has a first bracket portion 92*b* and a second bracket portion 94*b* with the angle β between each other. The first bracket portion 92*b* has an inner flange 92*b-i* and an outer flange 92*b-o* with an inner width $W_o$ between the two flanges, and the second bracket portion 94*b* has an inner flange 94*b-i* and an outer flange 94*b-o* with the inner width $W_o$ between the two flanges. The bracket portion 92*b* and bracket portion 94*b* are connected by a top bridging plate $\mathbf{96}b_1$ and a bottom bridging plate $\mathbf{96}b_2$.

In the inner corner anchor 80, top corner bracket 80*a* and base corner bracket 80*b* have the same structure of top corner bracket 90*a* and base corner bracket 90*b*, respectively, as described above, except that the corresponding inner width W between two flanges in the top and base corner bracket 80*a*, 80*b* is in mating relationship with the thickness of the first and second end sections 26, 28 of inner form boards 20.

As shown in FIG. 9, in footing form assembly 10 both inner corner anchor 80 and outer corner anchor 90 have the same orientation, namely, with the bridging plates facing the interior of the building. Two outer form boards 30 on two sides of the corner are joined and anchored by an outer corner anchor 90, with the outer form boards 30 affixed between the top corner bracket 90*a* and base corner bracket 90*b*. Two inner form boards 20 at the inner side of the corner are joined and anchored by an inner corner anchor 80 in the same manner. As can be appreciated, because of the structural similarity between the inner and outer corner anchors, when the inner and outer form boards 20, 30 have the same thickness, the outer corner anchor 90 is the same as the inner corner anchor 80, and can be used interchangeably.

Figure 11A:
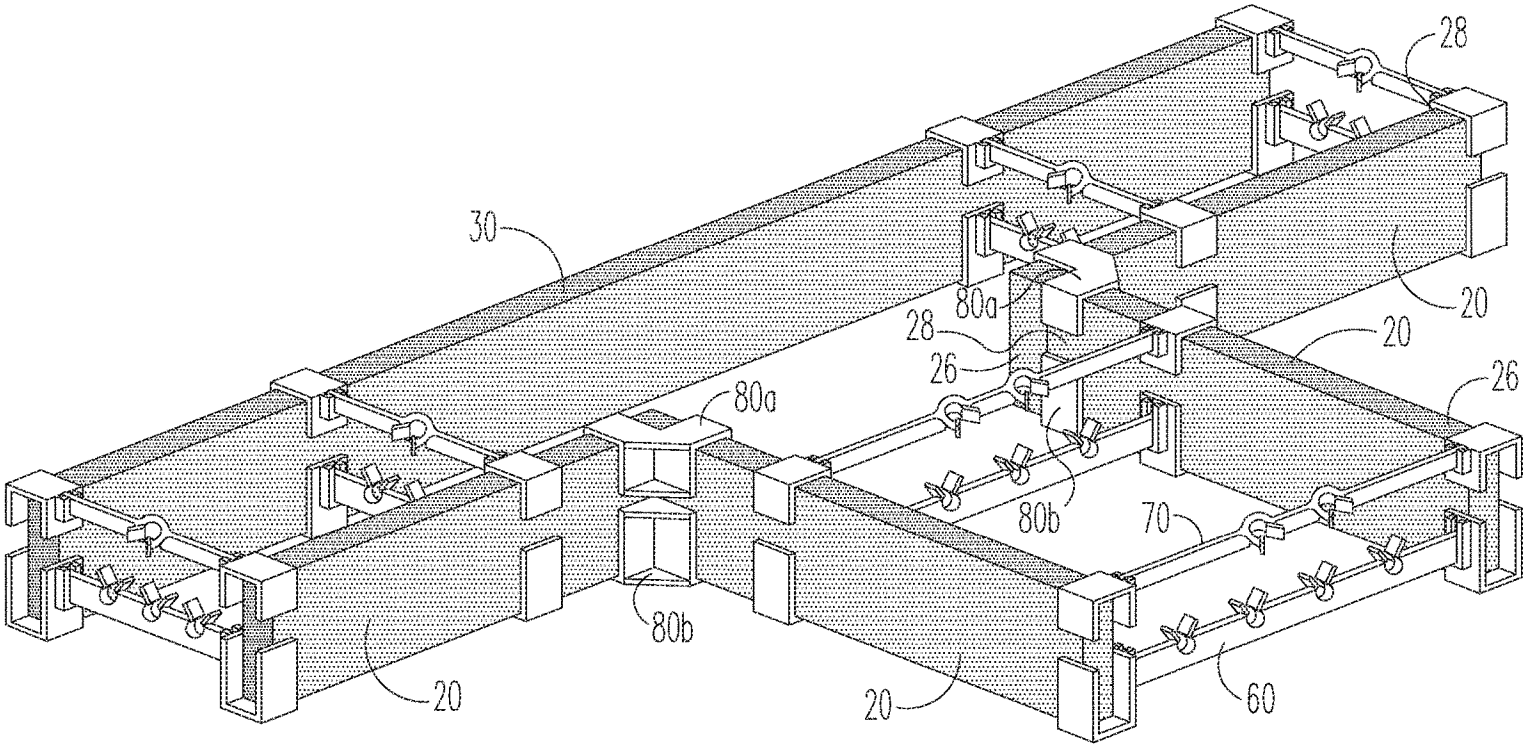
FIG. 11A is a perspective view of a T-connection section of the stay-in-place footing form assembly.
Figure 11B:
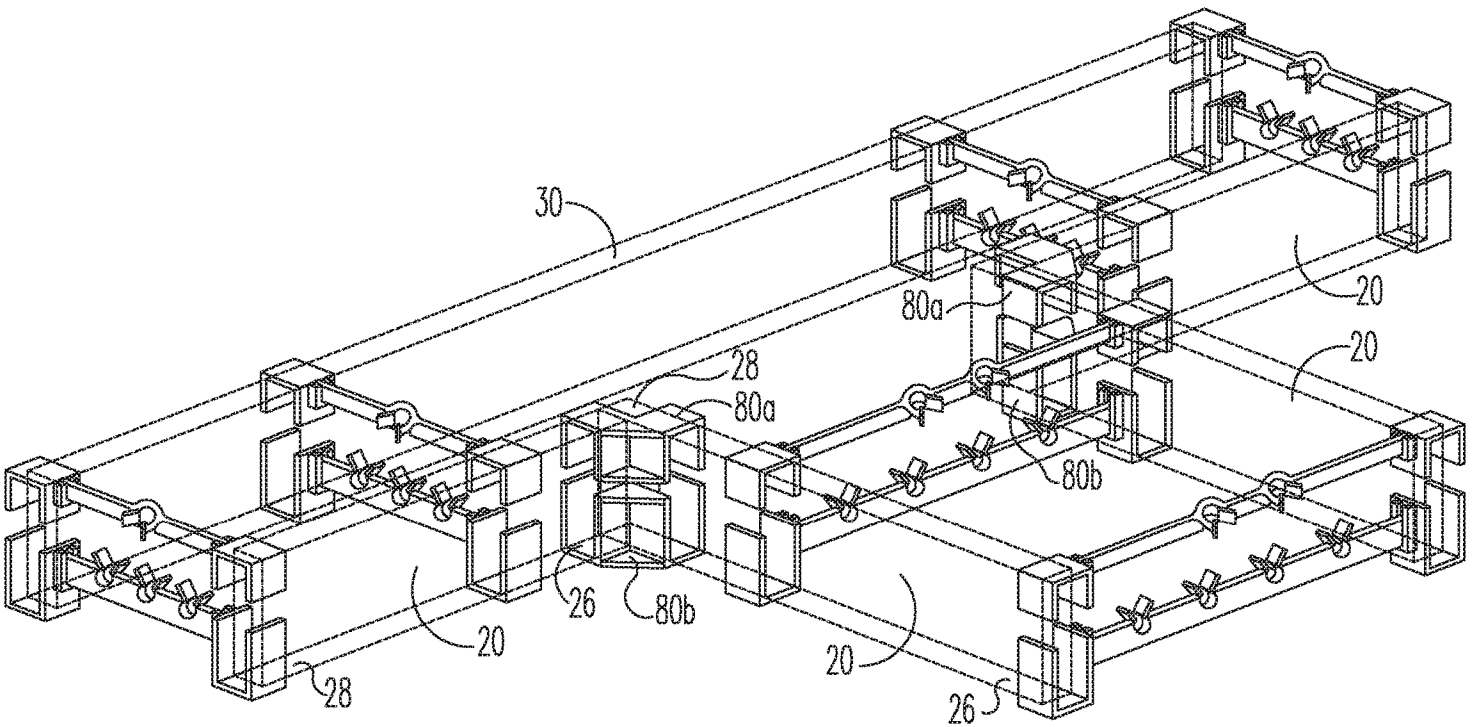
FIG. 11B is the T-connection section shown in FIG. 11A with the inner and outer form boards in phantom.
Figure 12:
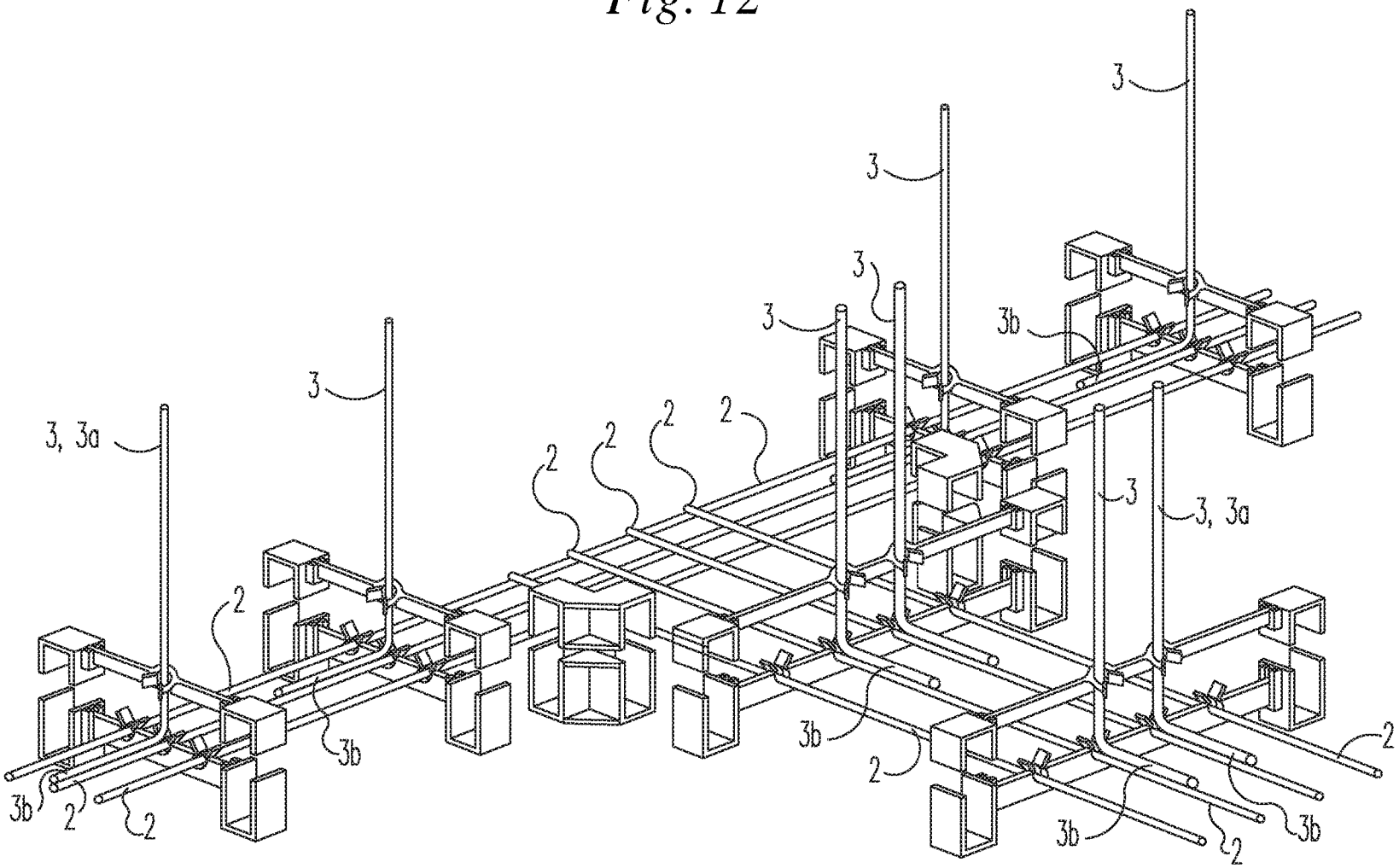
FIG. 12 is a perspective view of the T-connection section shown in FIG. 11A, with horizontal and vertical dowel rebars installed in the footing form assembly, wherein the inner and outer form boards are removed for showing the positions of the horizontal and vertical dowel rebars in the footing form assembly.

FIG. 11A further illustrates the use of corner anchors in the footing form assembly 10 for a concrete footing for a building. FIG. 11A shows a T-connection section of the footing form assembly 10. As shown, top corner bracket 80*a* and base corner bracket 80*b* of an inner corner anchor are used to connect two inner form boards 20 on two sides of each corner. As can be seen in FIG. 11A, as well as in FIG. 11B in which the form boards 20, 30 are in phantom to show relevant components more clearly, the first end section 26 of a form board 20 at one side of a corner and the second end section 28 of a form board 20 at the other side of the corner are against each other at a right angle within each inner corner anchor. FIG. 12 further shows this T-connection section of the footing form assembly 10 after horizontal rebars 2 and vertical dowel rebars 3 are installed in the assembly, in which the inner and outer form boards are removed for showing the positions of the horizontal and vertical dowel rebars.

Moreover, FIG. 13 further illustrates the use of corner anchors in the footing form assembly 10 at a dead end of a building structure. As shown, top and base corner brackets 90*a*, 90*b* of an outer corner anchor is used to connect two outer form boards 30 on two sides of each corner.

The inner and outer form boards 20, 30 can be made of various materials that are suitable for providing supports during construction of the concrete footing and staying with the concrete footing after construction. In some embodiments, the inner and outer form boards 20, 30 may be made of insulation boards which may be constructed of a material which has an ability of absorbing impact forces of earthquakes and/or has a thermal insulation property, for example, polymeric materials, such as polystyrene, polyurethane, and composites. In some embodiments, rigid polymeric foam boards, such as expanded polystyrene foam (EPS) boards or polyurethane foam boards, are used, which are herein referred to as insulation foam boards.

Insulation foam boards are known to have thermal insulation properties, which can reduce heat loss of a building to surrounding soils through its footing. More importantly, in the instant stay-in-place footing form, the insulation foam boards can be compressed or deformed by a lateral force exerted by an earthquake to the footing, which is herein also referred to as an impact force of an earthquake or an earthquake force. In other words, using the instant stay-in-place footing form an absorption of at least a portion of the impact force from earthquakes by compression or deformation of the insulation foam boards reduces the extent of a direct impact of earthquakes to the footing as the foundation of a building, and hence reduces an overall impact to the building. The insulation foam boards are prefabricated by the manufacturer of the footing form assembly, and however, they can also be cut conveniently at a construction site when a length adjustment is needed. In addition, insulation foam boards are light weighted and inexpensive. Therefore, they are particularly advantageous.

In the embodiment shown in FIGS. 1A and 1B, the inner and outer form boards 20, 30 may be insulation foam boards. As shown, both inner and outer form boards are substantially planar and have a rectangular cross section. In other words, the thickness of each form board is the same through the entire length of the form board. The inner form boards 20 and outer form boards 30 have a predetermined thickness, respectively, which is determined in consideration of several aspects, including a required strength of the form boards of the footing form in construction of concrete footings, a desired absorbing capacity to impact forces of earthquakes, optionally a desired thermal insulation capacity provided by the form boards, as well as manufacturing related factors. The thickness may be the same or different between the outer form boards 30 and inner form boards 20, depending the architectural structure and location of a building, and can be determined by architects and structural engineers. In some embodiments, the thickness of the inner or outer form boards made of the insulation foam boards may be from about 1.5 inches to about 48 inches.

For assessing a desired absorbing capacity of the form boards to a lateral force exerted by an earthquake, the extent of compression or displacement of the form boards in response to the lateral force may be determined based on multiple factors, which in general is a function of the weight of a building to be constructed, potential lateral forces of earthquakes according to respective earthquake zones and type of soils where the footing is to be constructed, compression coefficient of the material to be used as the form boards, and other relevant factors. In one exemplary embodiment, the extent of compression or displacement of the form boards in response to a lateral force may be calculated with the following equation:

$$D=V/(M_x*A)$$

wherein D is the extent of compression or displacement of the form boards, V is an estimated total lateral force exerted by an earthquake to a building which is a function of the weight of the building, $M_x$ is a compression coefficient of the form board material, and A is the total area of the form boards in the stay-in-place footing form of the building facing the direction of the lateral force.

In one example, the extent of compression of the insulation foam boards in the stay-in-place footing form of a concrete footing for a one-story building is assessed. The building is 20 feet in length, 15 feet in width and 10 feet in height, and has a weight of 40,000 lbs. The concrete footing is one foot in depth, and the expected lateral force exerted by earthquakes to the concrete footing based on the building weight is 4,800 lbs. The insulation foam boards used in the stay-in-place footing form have a material compression coefficient ($M_x$) of 10 pounds per square inch ($lb/in^2$) for 10% deformation. In this example, assume the longer side (i.e., 20 feet) of the building faces the direction of the lateral force. The total area of the form boards in the stay-in-place footing form of the building facing the lateral force (A) would be 5,760 $in^2$, based on the depth of the footing and a total length of the footing form facing the direction of the lateral force. According to the above equation, the extent of compression of the insulation foam boards would be 0.083 inch in response to the lateral force of 4,800 lbs. Such a compression of the insulation foam boards in response to the lateral force absorbs at least partially the impact force exerted to the concrete footing by an earthquake, which reduces a direct impact to the building and potential damages to the concrete footing and the building.

In the above example, insulation foam boards are used. As discussed above, form boards made of other materials which have an ability of absorbing impact forces function similarly. In addition, in some embodiments the inner and outer joining brackets of the instant stay-in-place footing form assembly may be made of a material that is deformable or can be broken in response to the earthquake force exerted to the concrete footing, as such the joining brackets distributed throughout the footing form act in consistent with the insulation foam boards and do not form pressure points to the concrete footing under the impact force.

Figure 14:
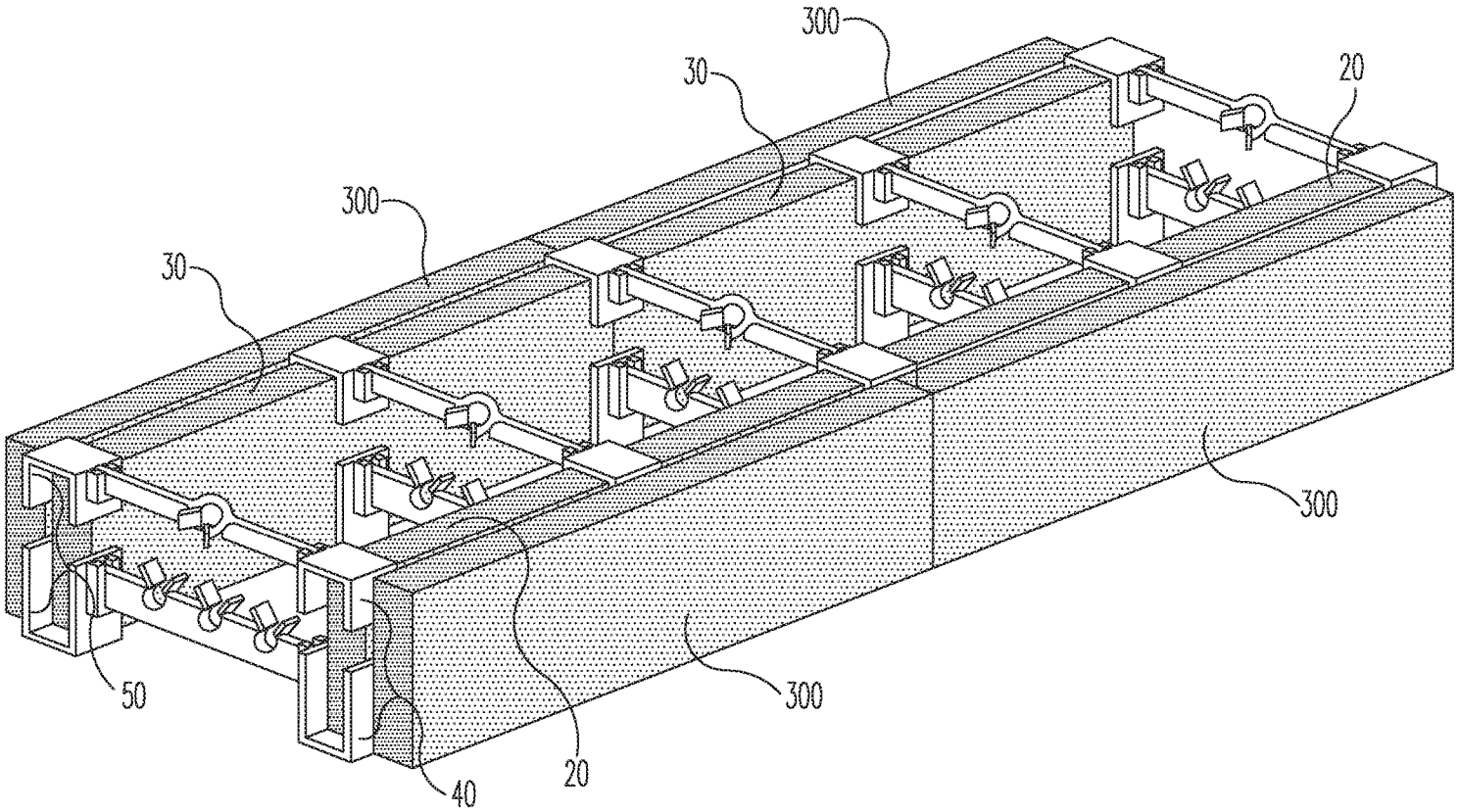
FIG. 14 illustrates a stay-in-place footing form assembly in a further embodiment, which includes a plurality of free standing insulation foam boards.

In a further embodiment, the stay-in-place footing form assembly 10 may further include a plurality of free standing form boards 300, such as insulation foam boards, aligned serially along and against the external side of the assembled inner form boards, outer form boards, or both throughout the footing form, as illustrated in FIG. 14. In this embodiment, the combined thickness between the assembled form boards, such as the outer form boards 30, and the free standing form boards 300 provides the desired properties, such as an absorbing capacity to the impact force of earthquakes and a thermal insulation property. With this embodiment, the inner and outer form boards 20, 30 may have the same thickness for different footings which may require different thickness of form boards, and the desired total thickness for the form boards can be achieved conveniently using free standing form boards 300 of different thickness. This further simplifies manufacturing of the footing form assembly and project management of footing constructions, since the inner and outer joining brackets 40, 50 become the same.

Figure 15A:
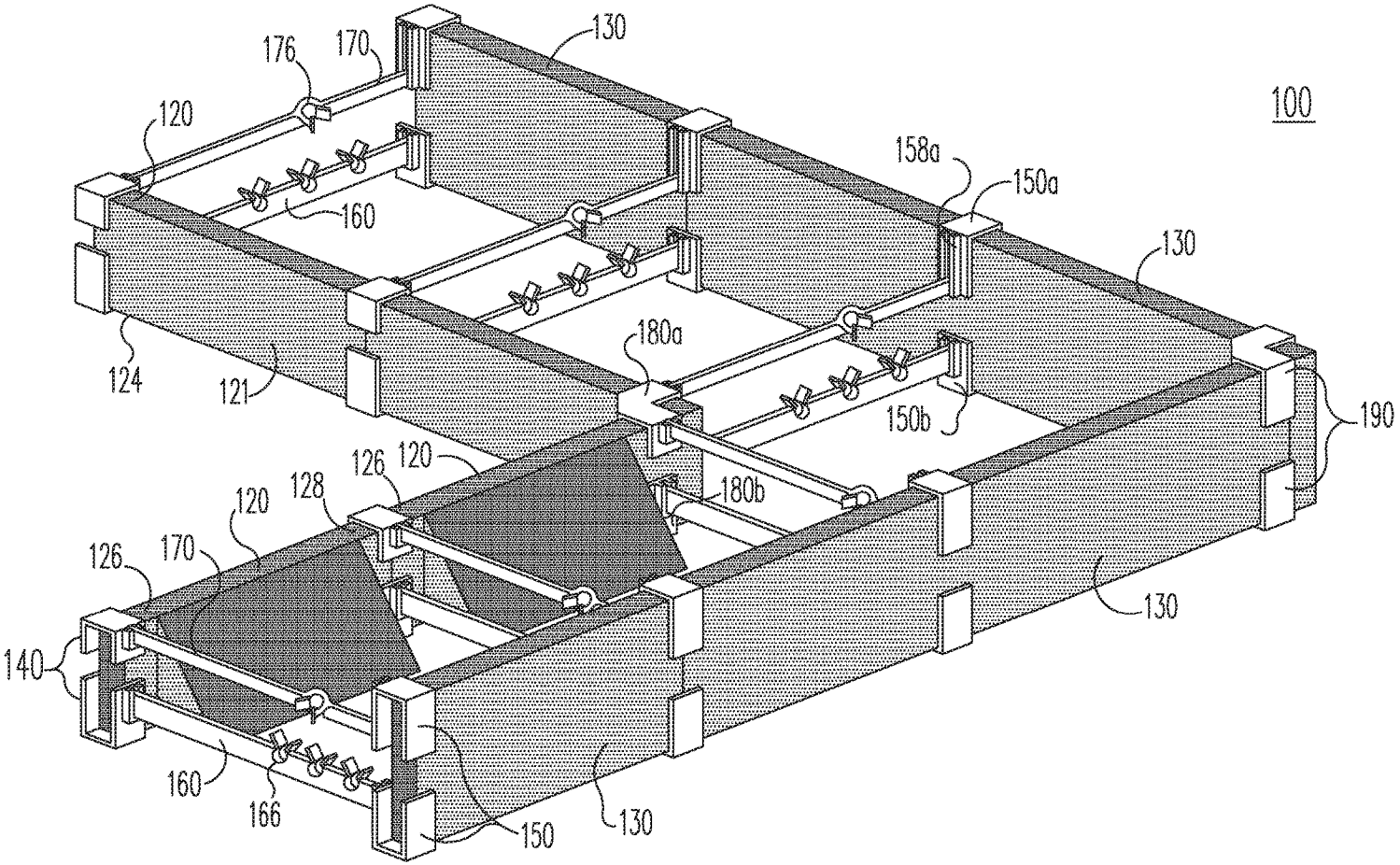
FIG. 15A is a perspective view of a section of a stay-in-place footing form assembly in another embodiment of the present invention.
Figure 15B:
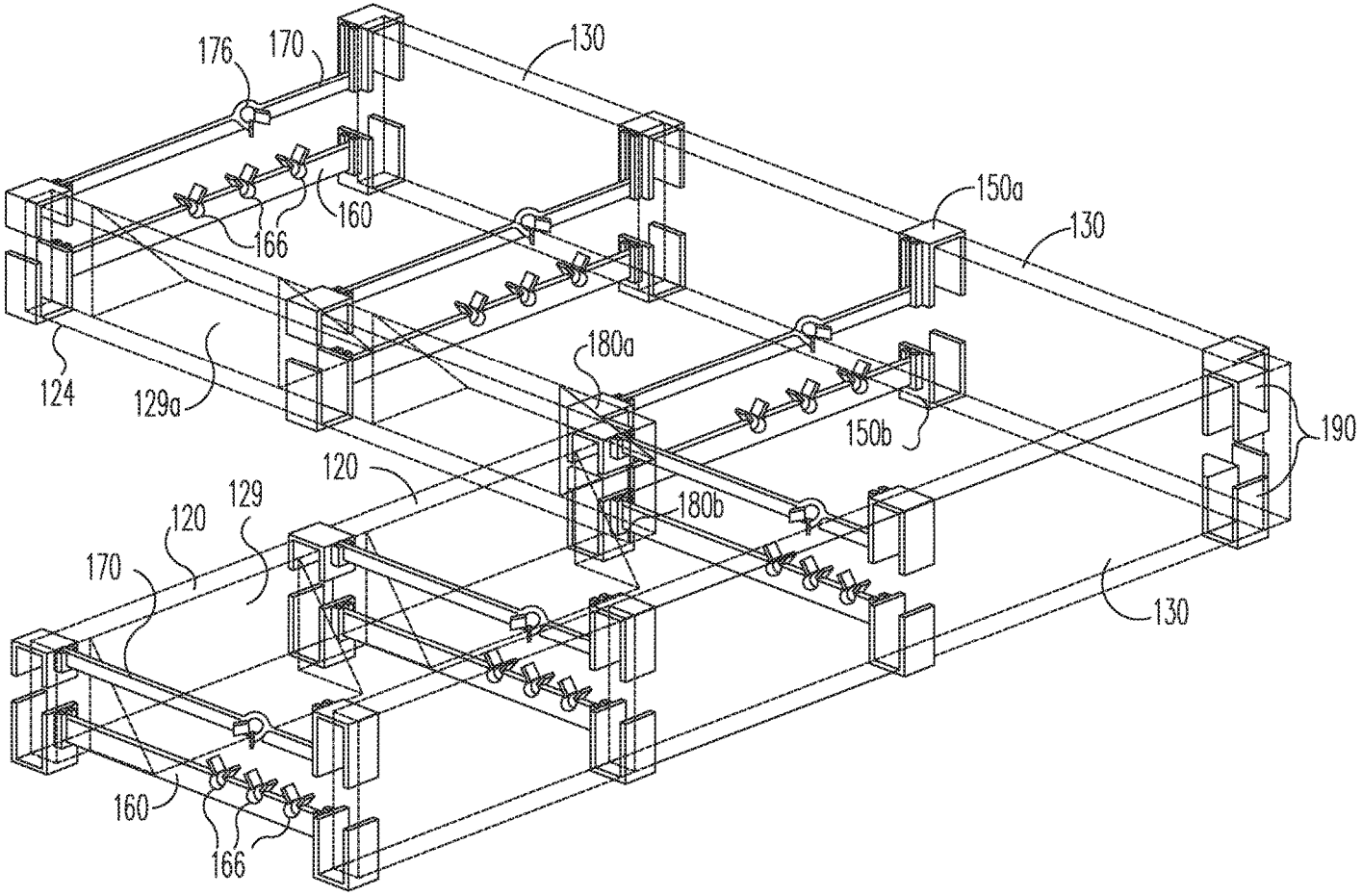
FIG. 15B is the section shown in FIG. 15A with the inner and outer form boards in phantom.
Figure 16A:
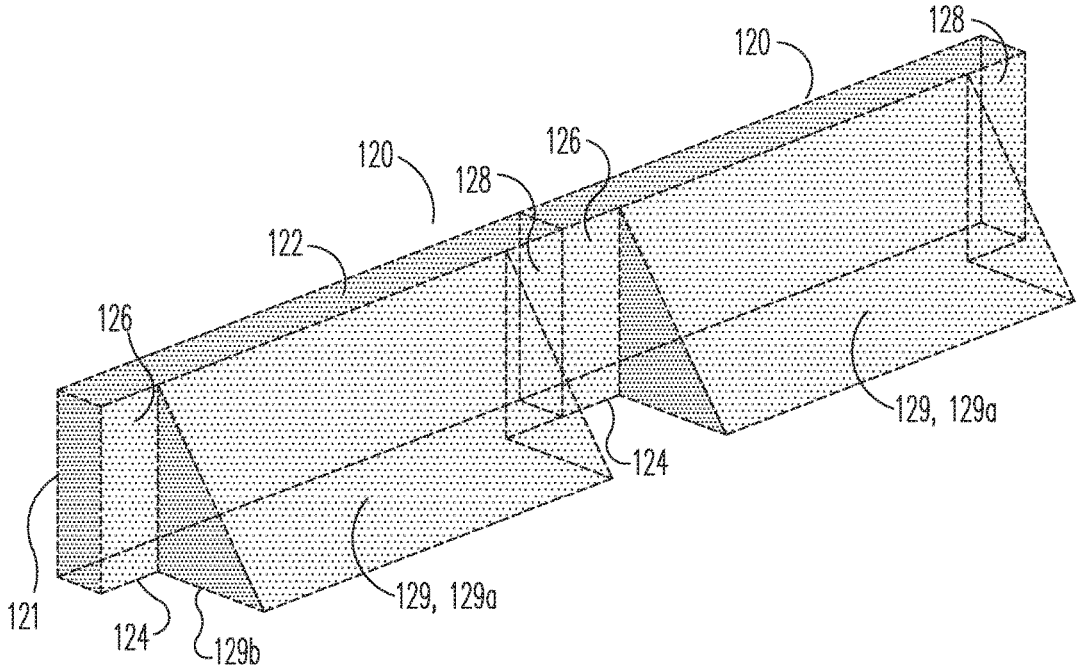
FIG. 16A is a perspective view of two inner form boards in the stay-in-place footing form shown in FIG. 15A.

FIGS. 15A and 15B show a stay-in-place footing form assembly 100 in some further embodiments of the present invention. As shown, in the footing form assembly 100 the inner form boards 120 are different from the outer form boards 130. The inner form boards 120 may further include an extended inner mid-section. FIG. 16A shows two inner form boards 120 next to each other in the same order in the footing form. As shown, inner form board 120 has a top 122, a first end section 126, a second end section 128, a planar external side 121, and an extended inner mid-section 129. The structure of the first and second end sections 126, 128 and the rectangular section therebetween are the same as in the inner form boards 20 described above. In the embodiment shown, extended inner mid-section 129 has a triangular cross section with an inclined upper side 129*a* and a planar base 129*b*. The planar base 129*b* is in flush with the bottom of the rest of the form board.

With insulation foam boards, the extended inner mid-section 129 can be formed directly by molding or by cutting a foam block to produce two insulation foam boards 120. The first end section 126 and second end section 128 of the inner form boards 120 have a predetermined thickness, which can be determined in the same manner of determining the thickness of form boards 20, 30 described above. As can be appreciated, the inner form boards 120 have additional earthquake force absorbing capacity and thermal insulation capacity at the extended inner mid-section 129.

In the embodiment shown in FIG. 15A, the footing form assembly 100 is provided for a monolithic concrete footing, in which the inner form boards 120 have a lesser height than the outer form boards 130, and the height difference between the inner and outer form boards is essentially the depth of a concrete slab of the building. The extended inner mid-sections 129 of inner form boards 120 in the footing form assembly 100 substantially reduce the amount of concrete used for constructing a monolithic concrete footing, and hence, the footing form assembly 100 reduces construction cost substantially.

In the footing form assembly 100, the structure of the outer form boards 130 is the same as that of the outer form boards 30 described above. The structures of inner joining brackets 140 and outer joining brackets 150 are essentially the same as those of inner and outer joining brackets 40, 50 described above in the footing form assembly 10, except that in the outer joining brackets 150, the flanges of the top brackets 150*a* are longer and rail receptacles 158*a* may be similarly longer to compensate for the height difference between the inner and outer form boards 120, 130, as shown in FIGS. 15A and 15B. With such a height compensation, the installed upper spacing rails 170 are leveled. Alternatively, the rail receptacle 158*a* may be positioned lower on the top bracket 150*a*, rather than structured longer, to achieve the height compensation between the inner and outer form boards 120, 130.

Figure 15C:
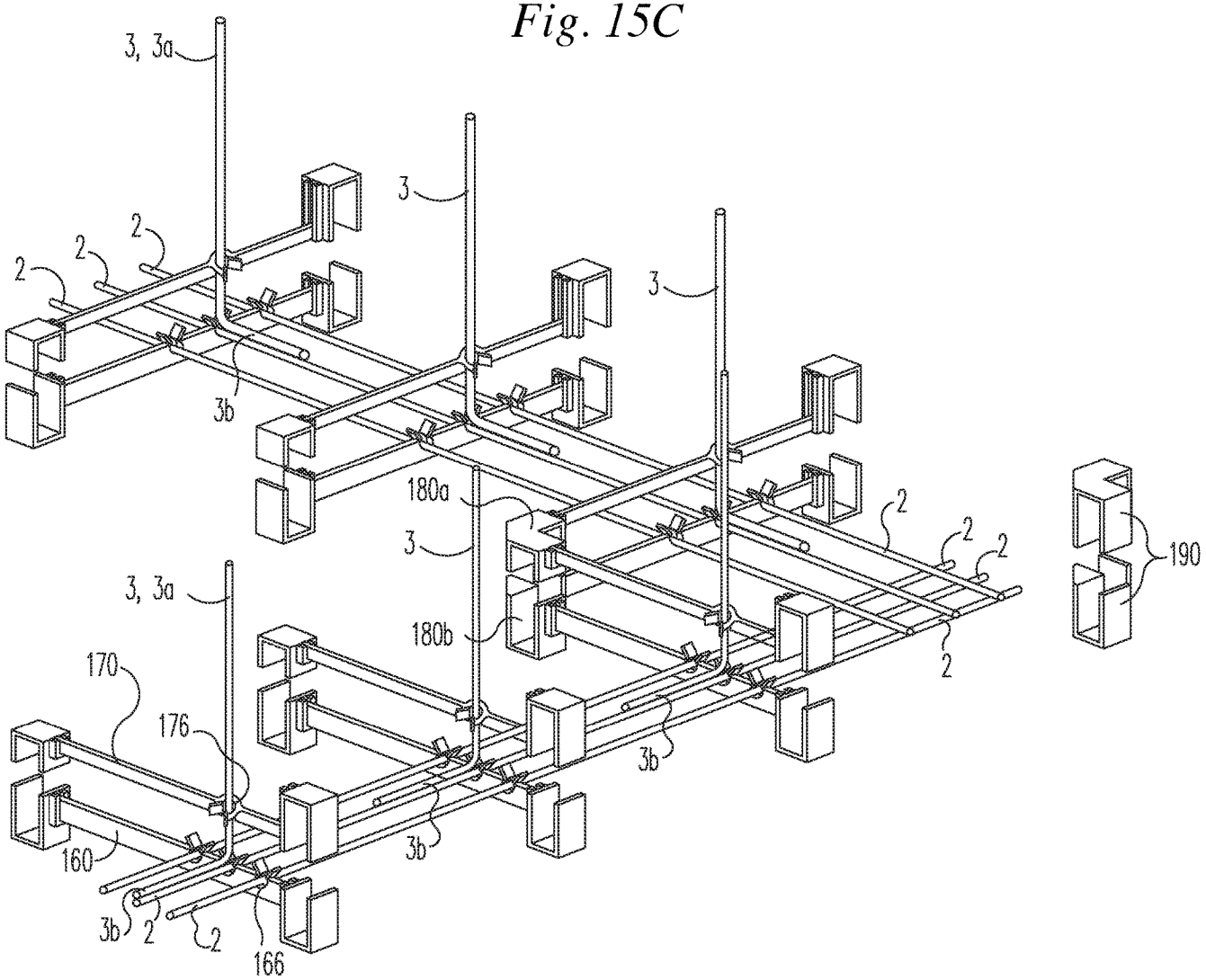
FIG. 15C is a perspective view of the section shown in FIG. 15A with horizontal and vertical dowel rebars installed in the footing form assembly, wherein the inner and outer form boards are removed for showing the positions of the horizontal and vertical dowel rebars in the footing form assembly.

In the footing form assembly 100, the structures of the lower and upper spacing rails 160, 170 are the same as the lower and upper spacing rails 60, 70, respectively, described above, except that the first rebar receptacles 166 on the lower spacing rails 160 and the second rebar receptacles 176 on the upper spacing rails 170 are disposed only in the portion of the spacing rails that do not overlap with the extended inner mid-section 129 of the inner form boards, see FIGS. 15A and 15B. Therefore, the extended inner mid-section 129 of the inner form boards do not interfere with the horizontal and vertical dowel rebars to be installed in the footing form. FIG. 15C further illustrates the section of the footing form assembly 100 shown in FIG. 15A with horizontal and vertical dowel rebars installed in the assembly, wherein the inner and outer form boards are removed for showing the positions of the horizontal and vertical dowel rebars in the footing form.

In the footing form assembly 100, the connections between the outer form boards 130 and outer joining brackets 150, between the inner form boards 120 and inner joining brackets 140, and between the lower and upper spacing rails 160, 170 and corresponding inner and outer joining brackets 140, 150 are the same as those in the footing form assembly 10 described above.

Figure 16B:
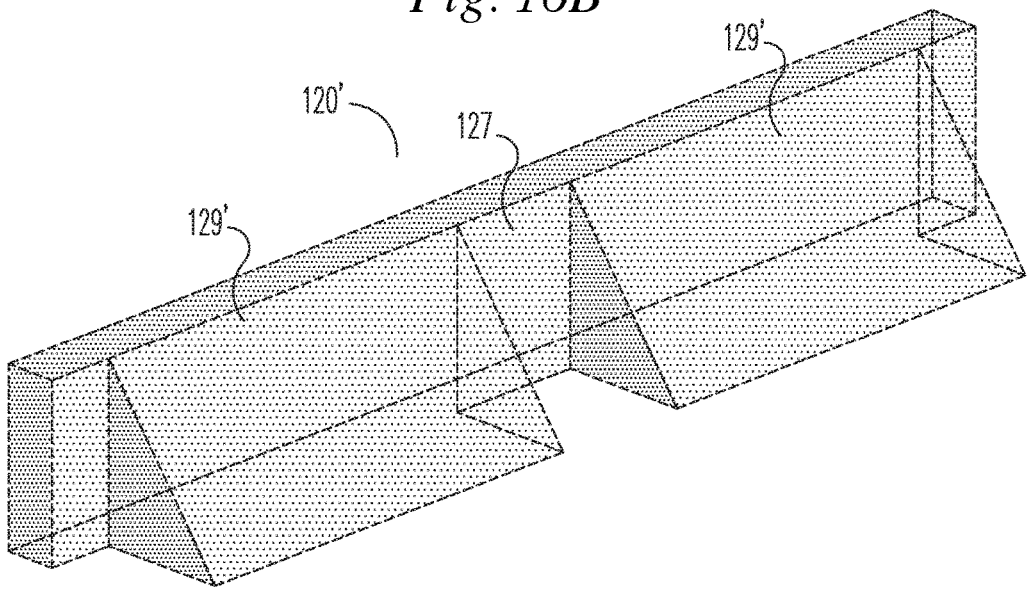
FIG. 16B is a perspective view of an inner form board in an alternative embodiment.

FIG. 16B further shows an alternative configuration of an inner form board 120'. As shown, inner form board 120' has more than one extended inner mid-sections 129'. The narrow section 127 between two extended inner mid-sections 129' is equivalent to the joined first end section 126 and second end section 128 of the two form boards 120 shown in FIG. 16A. A pair inner joining brackets 140 may be attached to section 127, which then allows connections of the lower and upper spacing rails at the middle of the inner form board 129'.

The footing form assembly 100 further includes a plurality of outer corner anchors 190 and inner corner anchors 180, see FIGS. 15A-15C and FIG. 17. The structure of outer corner anchor 190 is the same as the structure of the outer corner anchor 90 in the footing form assembly 10 described above. However, as shown in FIGS. 15A-15C, the inner corner anchor 180 further includes two rail receptacles on the top corner bracket 180*a*, and two rail receptacles on the base corner bracket 180*b* for connections with upper and lower spacing rails 170, 160, respectively, on two sides of a corner.

Figure 17:
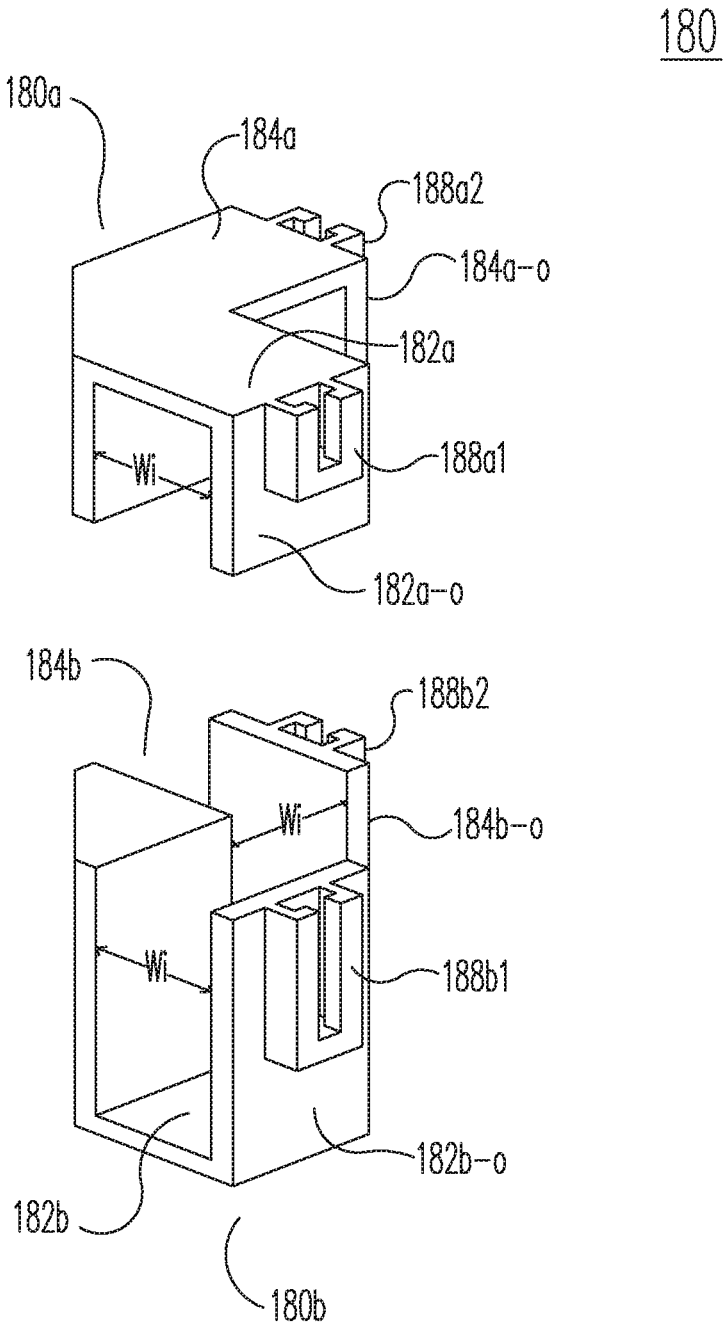
FIG. 17 is a perspective view of a top corner bracket and a base corner bracket in an inner corner anchor in the stay-in-place footing form shown in FIG. 15A.

FIG. 17 shows a top corner bracket 180*a* and a base corner bracket 180*b*, respectively, of the inner corner anchor 180.

As shown, top corner bracket 180*a* has a rail receptacle 188*a*1 on the outer flange 182*a-o* of the first bracket portion 182*a* and a rail receptacle 188*a*2 on the outer flange 184*a-o* of the second bracket portion 184*a*. The structure of rail receptacles 188*a*1, 188*a*2 may be the same as the structure of the receptacles 48*a*, 58*a* on the top brackets of inner and outer joining brackets 40, 50 described above. As further shown, base corner bracket 180*b* has a rail receptacle 188*b*1 on the outer flange 182*b-o* of the first bracket portion 182*b* and a rail receptacle 188*b*2 on the outer flange 184*b-o* of the second bracket portion 184*b*. The structure of rail receptacles 188*b*1, 188*b*2 may be the same as the structure of the receptacles 48*b*, 58*b* on the base brackets of inner and outer joining brackets 40, 50 described above.

Similar to footing form assembly 10, free standing form boards 300 can be placed around the inner and outer form boards 120, 130 in the footing form assembly 100 in the same manner described above in reference to FIG. 14.

The stay-in-place footing form assembly 10 or 100 can be used to construct different types of concrete footings, such as spread footings, monolithic footings, stem wall footings, and other concrete footings. In construction of spread footings and stem wall footings, the inner form boards 20 and the outer form boards 30 described above have the same height. In construction of monolithic footings, the height of the inner form boards 120 is less than the height of the outer form boards 130, and a concrete paste is poured over the inner form boards 120 to form a concrete slab of a building together with the concrete footing.

Figure 18A:
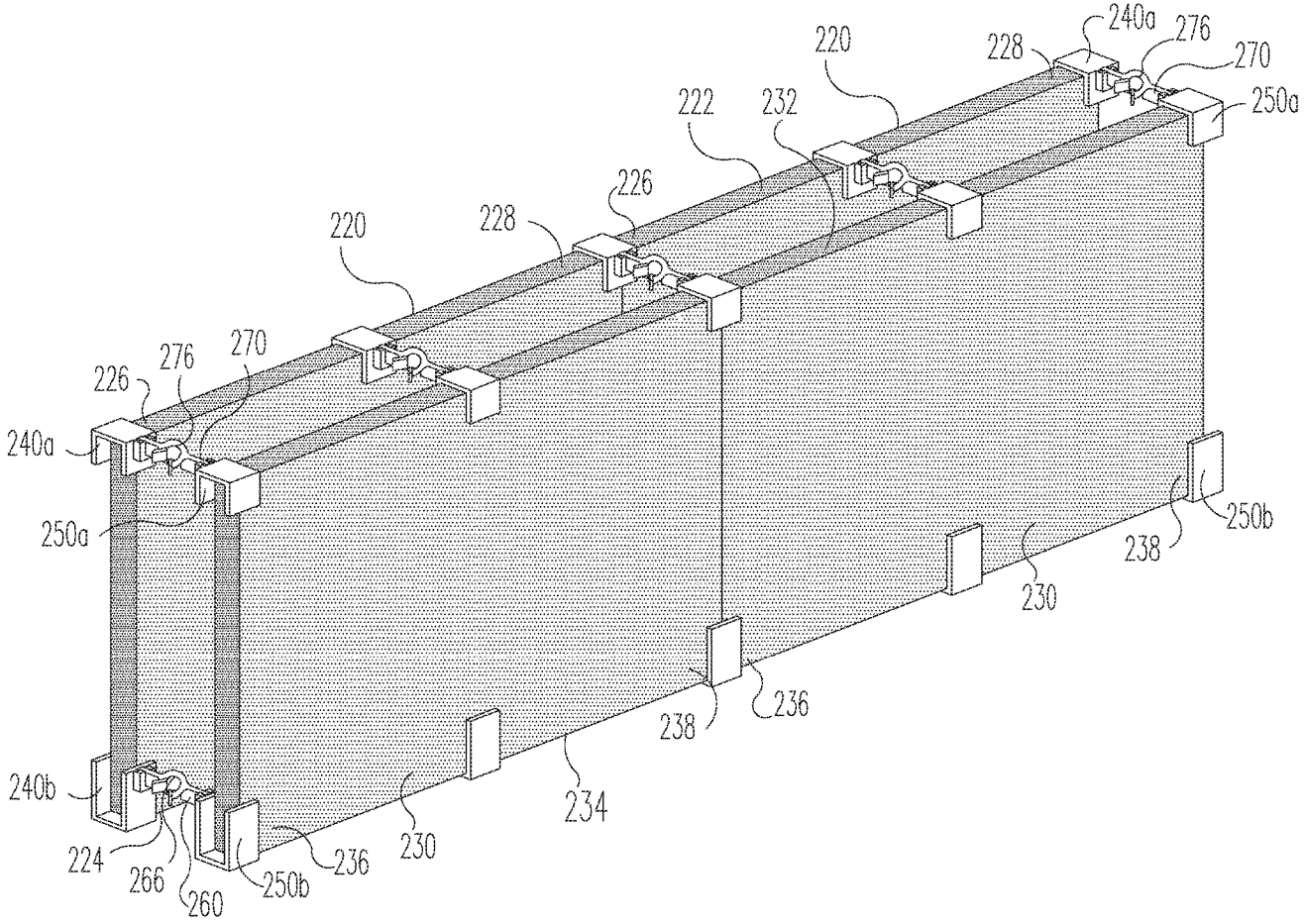
FIG. 18A is a perspective view of a section of a stay-in-place stem wall footing form subassembly.

In some further embodiments, the stay-in-place footing form assembly of the present invention further includes a stay-in-place stem wall footing form subassembly to be constructed on top of a concrete spread footing formed with the stay-in-place footing form assembly 10 described above. FIG. 18A shows a portion of a stay-in-place stem wall footing form subassembly 200. The stem wall footing form subassembly 200 comprises a plurality of inner stem wall form boards 220 joined serially by a plurality of pairs of inner stem wall joining brackets 240*a*, 240*b*, a plurality of outer stem wall form boards 230 joined serially by a plurality of pairs of outer stem wall joining brackets 250*a*, 250*b*, and a plurality of lower and upper stem wall spacing rails 260, 270 disposed between and connecting corresponding inner and outer stem wall joining brackets.

As further shown in FIG. 18A, each of inner stem wall form boards 220 and outer stem wall form boards 230, respectively, has a top 222, 232, a bottom 224, 234 and a first end section 226, 236 and an opposing second end section 228, 238. The inner stem wall form boards 220 aligned in series with the first end section 226 and the second end section 228 of two immediately adjacent inner stem wall form boards against each other, and outer stem wall form boards 230 are aligned in the same manner. The thickness of inner stem wall form boards 220 and outer stem wall form boards 230, respectively, can be determined in the same manner of determining the thickness of form boards 20, 30 described above.

The structures of the pair of inner stem wall joining brackets 240*a*, 240*b* are the same as those of inner joining brackets 40 described above, except that the inner width between two flanges of the top brackets 240*a* or the base brackets 240*b* in the inner stem wall joining brackets is in mating relationship with a predetermined thickness of inner stem wall form boards 220. Similarly, structures of the pair of outer stem wall joining brackets 250*a*, 250*b* are the same as those of outer joining brackets 50 described above, except that the inner width between two flanges of the top brackets 250*a* or the base brackets 250*b* in the outer stem wall joining brackets is in mating relationship with a predetermined thickness of outer stem wall form boards 230.

In stem wall footing form subassembly 200, the structure of the lower and upper stem wall spacing rail 260, 270 is the same, and it is substantially the same as the upper spacing rail 70 described above, except that the stem wall spacing rails 260, 270 have a predetermined length according to the width of a stem wall footing to be constructed. The connections between the lower stem wall spacing rail 260 and the inner and outer stem wall joining brackets 240*b*, 250*b*, and between the upper stem wall spacing rail 270 and the inner and outer stem wall joining brackets 240*a*, 250*a* are the same as those in the footing form assembly 10 described above.

Figure 18B:
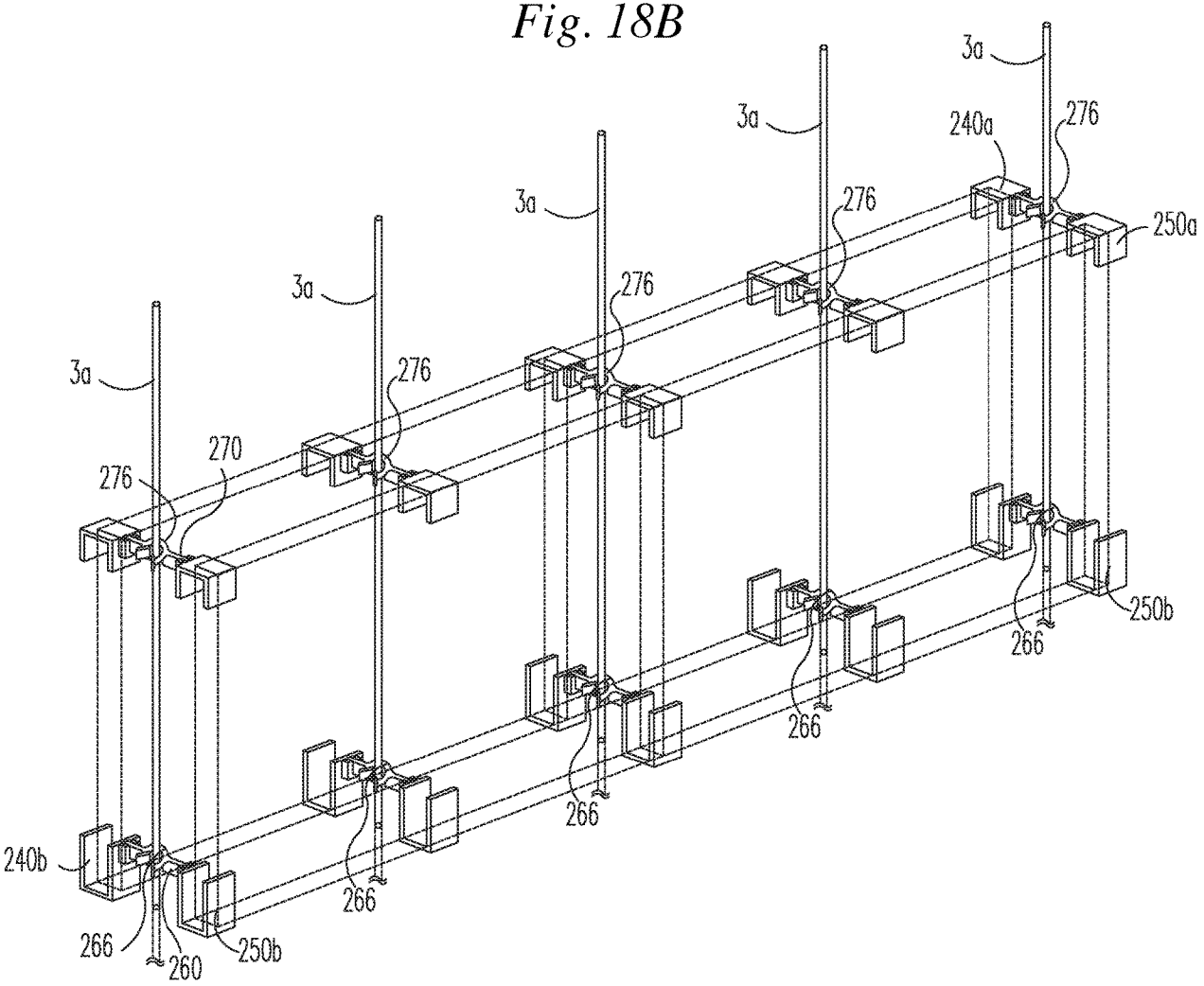
FIG. 18B is the section of the stem wall footing form subassembly shown in FIG. 18A with vertical rebars installed in the stem wall footing form subassembly, wherein the inner and outer stem wall form boards are in phantom.

As further shown in FIG. 18A, each lower and upper stem wall spacing rail 260, 270 includes one or more vertical rebar receptacles 266, 276. In stem wall footing form subassembly 200, the vertical rebar receptacles 266 and 276 in the lower and upper stem wall spacing rails are aligned with the second rebar receptacles 76 in the upper spacing rails 70 of the footing form assembly 10. As such, the vertical portion 3*a* of a vertical dowel rebar 3 protruding from a concrete footing formed in the footing form assembly 10 is situated in the vertical rebar receptacles 266 and 276 of the lower and upper stem wall spacing rails 260, 270, as shown in FIG. 18B. The vertical portion 3*a* of vertical dowel rebar 3 may further be fastened to the lower and upper stem wall spacing rails 260, 270 by fastening means before pouring a concrete paste into the stem wall footing form subassembly 200.

Moreover, in an alternative embodiment, in the stem wall footing form subassembly 200 the two top brackets and the upper stem wall spacing rail may be prefabricated as a single piece structure, and the two base brackets and the lower stem wall spacing rail may be prefabricated as a single piece structure, in the same manner described above in reference to FIGS. 8A and 8B.

In another aspect, the present invention further provides methods of constructing concrete footings using the stay-in-place footing form assemblies described above. FIGS. 19A-19H illustrate schematically a process of constructing a concrete spread footing using the stay-in-place footing form assembly 10.

Figure 19A:
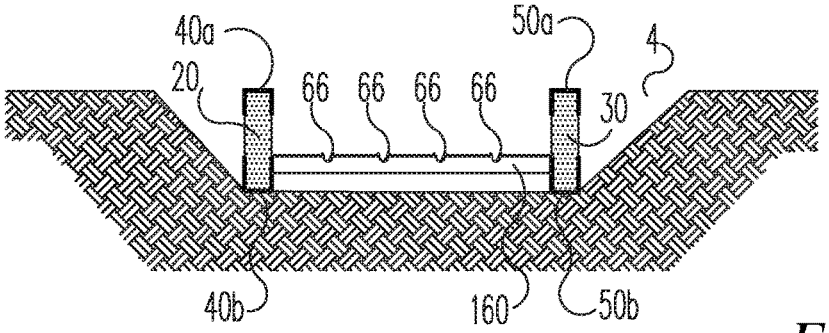

As shown in FIG. 19A, in a trench 4 excavated for a concrete footing, a stay-in-place footing form assembly 10 is constructed. A plurality of inner form boards 20 are first laid out in series in the trench, and similarly the outer form boards 30 are laid out according to the design of the footing to be constructed. In the process, the first end section 26 of an inner form board 20 and the second end section 28 of an immediately adjacent inner form board 20 are inserted into a base bracket 40*b* of an inner joining brackets 40 to join the two inner form boards together at their interface. The same connection is made with other inner form boards 20 in series along trench 4 to connect all inner form boards of the footing form assembly. Similarly, the outer form boards 30 laid out in trench 4 are connected by base brackets 50*b* of outer joining brackets 50 in the same manner. At each corner of the footing to be constructed, a base corner bracket 80*b* of an inner corner anchor 80 is used to join two inner form boards 20 on two sides of the corner together as described above. Similarly, two outer form boards 30 on two sides of the corner are joined together by a base corner bracket 90*b* of an outer corner anchor 90.

In addition, as illustrated in FIG. 1C at locations where a joined interface between two immediately adjacent outer form boards 30 does not correlate, in the lateral direction of the trench, with an interface between two inner form boards 20 on the opposing side due to different lengths of the inner and outer form boards, an additional base bracket 40*b* is inserted onto the bottom of the inner form board 20 in line with the opposing base bracket 50*b* in the lateral direction. Similarly, an additional base bracket 50*b* is inserted onto the bottom of outer form board 30 in line with an opposing base bracket 40*b* that is used to join two inner form boards at their interface. Moreover, additional base brackets 40*b*, 50*b* can be added beyond the interface between two boards, as shown in FIG. 1A, to provide additional strength and additional supports for horizontal and vertical dowel rebars.

Then throughout the trench, at each interface between two immediately adjacent inner form boards 20, a top bracket 40*a* of inner joining brackets 40 are inserted on top of the two inner form boards to further connect the two form boards together from the top. In addition, at each location where an additional base bracket 40*b* is inserted on the inner form board 20, a top bracket 40*a* is also inserted and aligned with the base bracket 40*b* in the vertical direction. Similarly, top brackets 50*a* are installed on the outer form boards 30 throughout the assembly in the same manner.

Then the lower spacing rails 60 are installed between corresponding inner and outer joining brackets throughout the assembly. Two opposing ends of a lower spacing rail 60 are inserted into rail receptacle 48*b*, 58*b* of corresponding base brackets 40*b* and 50*b* aligned in the lateral direction through their open tops, which connects respective inner and outer base brackets, as well as the inner and outer form boards, together, see FIG. 19A and also FIGS. 1A-1B.

Figure 19B:
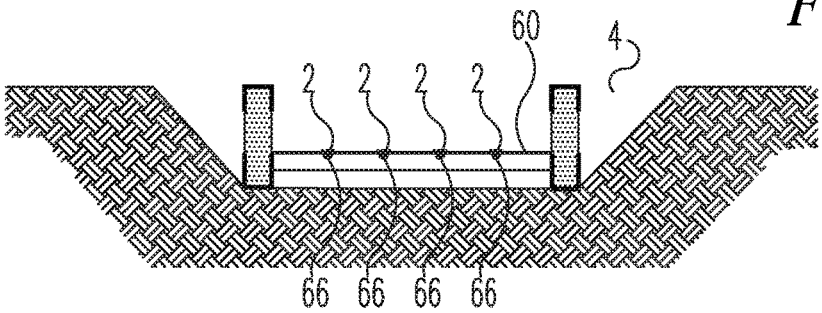

Once the lower spacing rails 60 are installed, horizontal rebars 2 are installed in the footing form assembly, see FIG. 19B. Commercial horizontal steel rebars can be up to 40 feet in length. Using the footing form assembly 10, horizontal rebars 2 are simply placed into the first rebar receptacles 66 on the lower spacing rails 60 which are aligned longitudinally in each section of the footing form assembly, see FIGS. 7 and 12. At the corners, the horizontal rebars 2 on one side of the corner may be laid over on the horizontal rebars 2 on the other side of the corner, or stay clear from the horizontal rebars 2 on the other side. No fastening of the horizontal steel rebars to the lower spacing rails 60 is needed.

Figure 19C:
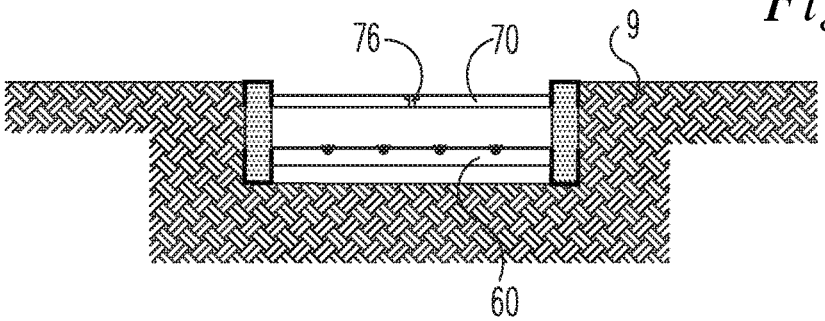

Then the upper spacing rails 70 are installed between the top brackets of corresponding inner and outer joining brackets throughout the assembly, see FIG. 19C. Two opposing ends of an upper spacing rail 70 are inserted into rail receptacle 48*a*, 58*a* of corresponding top brackets 40*a* and 50*a* through their open tops. This affixes the inner and outer form boards at their upper side.

Figure 19D:
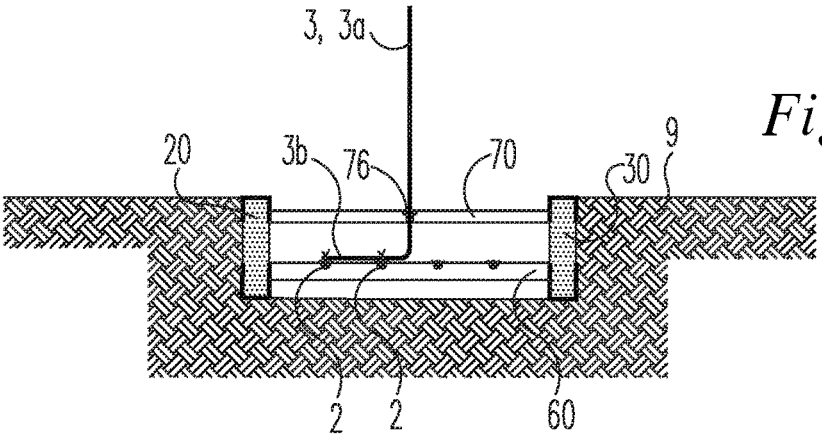

Once the upper spacing rails 70 are installed, vertical dowel rebars 3 can be installed throughout the footing form assembly, see FIG. 19D. FIGS. 7 and 12 illustrate sections of the footing form assembly after the rebars are installed. Typically, vertical dowel rebars 3 for constructing a concrete footing have a vertical portion 3*a* and horizontal portion 3*b*. As can be seen in FIGS. 7 and 12, the vertical portion 3*a* is placed into the second rebar receptacles 76 of upper spacing rails 70, and horizontal portion 3*b* may be disposed on top of horizontal rebars 2. The vertical portion 3*a* may be further secured to upper spacing rails 70 by fasten means described above. Optionally, the horizontal portion 3*b* of the vertical dowel rebars may be further fastened to horizontal rebars 2, or to lower spacing rails 60, by the fasten means. Commercially available and other known horizontal rebars and vertical dowel rebars may be used with the stay-in-place footing form assembly of the present invention.

The above described process is merely an example to illustrate one approach of installing the stay-in-place footing form assembly 10 and rebars for a concrete footing. Alternative approaches may also be used at the discretion of construction workers. For example, the lower spacing rails 60 may be connected to the base brackets 40*b* and 50*b* before installing the top brackets 40*a*, 50*a* onto the form boards. In some situations, horizontal rebars may also be installed after the upper spacing rails are installed. In another example, both top and base brackets of a pair of inner joining bracket 40 (or a pair of outer joining brackets 50) may be inserted on the second end section of an inner form board 20, then the first end section of a subsequent inner form board is inserted into this pair of joining brackets until the end sections of the two boards are against each other. The same process may continue along the trench to join the form boards.

After installing the upper spacing rails 70 between the inner and outer form boards, or during installation of vertical dowel rebars, soil 9 is repositioned to fill around the perimeter of the installed footing form assembly 10, see FIGS. 19C and 19D. If additional free standing foam boards are used as parts of the stay-in-place footing form, the free standing foam boards are placed against the inner form boards, the outer form boards, or both throughout the trench before filling the soil. The soil is filled to a height substantially equal to the top of the inner and outer form boards 20, 30, see FIGS. 19C and 19D.

Thereafter, a concrete paste 1 is poured into the footing form assembly 10. As shown in FIG. 19E, in constructing a concrete spread footing or stem wall footing, the concrete paste 1 is filled into the space within the footing form assembly 10 to a height substantially equal to the top of the inner and outer form boards 20, 30 such that the top of the concrete footing formed is in flush with the top of the inner and outer form boards 20, 30. Then, the concrete is fully cured within the footing form assembly, as such the stay-in-place footing form assembly 10 becomes an integral part of the concrete footing 5 formed.

Once the concrete footing 5 is formed, vertical rebars 3' for construction of walls of the building are placed on top of the concrete footing 5 and are attached to the portions of vertical dowel rebars 3 extending from the top of the concrete footing 5, see FIG. 19F. After a wall 7 is constructed as shown in FIG. 19G, a concrete paste is poured over the portion of the concrete footing 5 inside the wall 7 to form a concrete slab 6 of the building, see FIG. 19H.

As described above, insulation foam boards or other suitable insulation materials can be used as the inner and outer form boards, and with such materials an insulated concrete footing is formed. Since the footing form assembly 10 is an integral part of the concrete footing, the concrete footing formed with the instant stay-in-place footing form assembly is an integral insulated concrete footing. As further illustrated in FIG. 19I, in the event of an earthquake, a lateral force of the earthquakes will impact first on the inner or outer form boards of the stay-in-place footing form assembly 10. Under such a lateral force, a compression or deformation of the form boards absorbs at least a portion of the impact force and reduces the extent of the impact to the foundation of the building from the earthquake.

FIGS. 20A-20F further illustrate schematically construction of a monolithic concrete footing using stay-in-place footing form assembly 100. The process of installing the footing form assembly 100 is similar to the process of installing the footing form assembly 10 described above, see FIGS. 20A-20C. In this process, the inner form boards 120 are used, which have a different height from the outer form boards 130. In addition to installing the lower and upper spacing rails 160, 170 between the inner and outer joining brackets 140, 150, some of the spacing rails are installed between the inner corner anchor and the outer joining brackets 150 as described above, see FIG. 15A. FIG. 15C illustrates a portion of the footing form assembly 100 with the horizontal and vertical dowel rebars 2, 3 installed.

Moreover, in constructing a monolithic footing, in addition to installing of the footing form assembly 100 and horizontal and vertical dowel rebars 2, 3 as described above, necessary preparations for constructing a concrete slab of the building are also accomplished according to architecture design with known methods. All necessary reinforcing elements for the concrete slab, such as metal mesh or horizontal rebars, are installed, and if desired, are extended to the interface of the concrete slab with the footing form assembly.

Figure 20A:
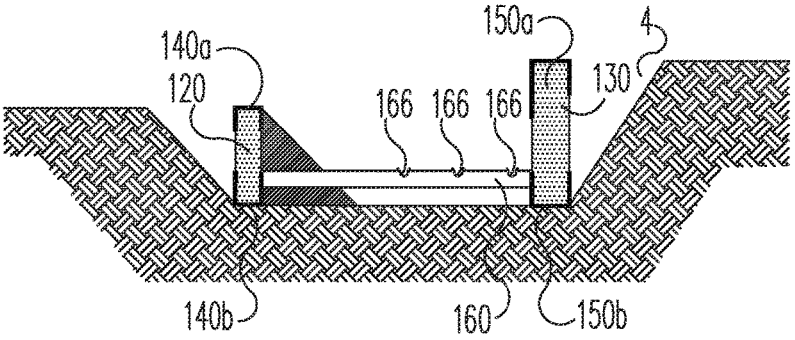
Figure 20B:
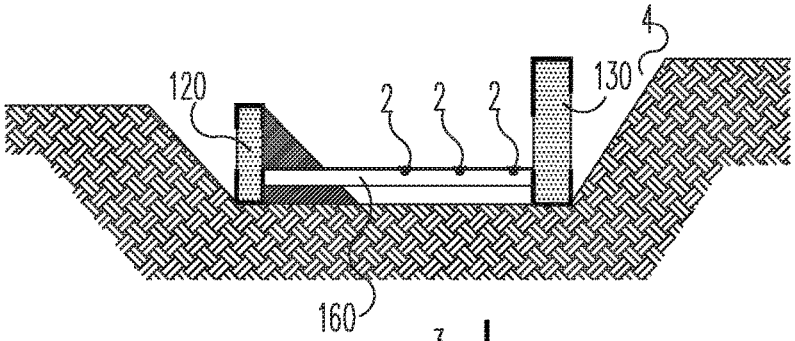
Figure 20C:
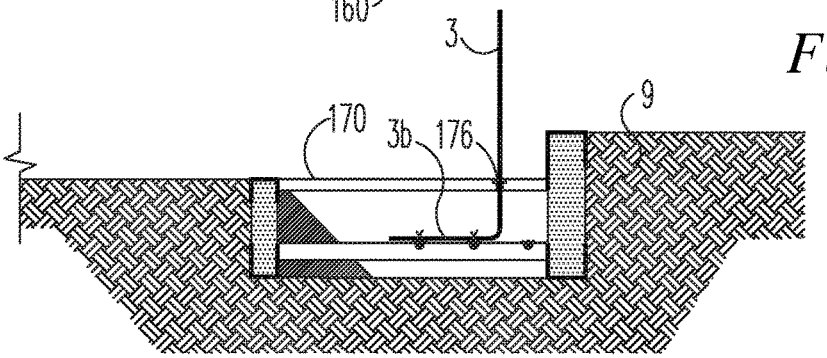
Figure 20D:
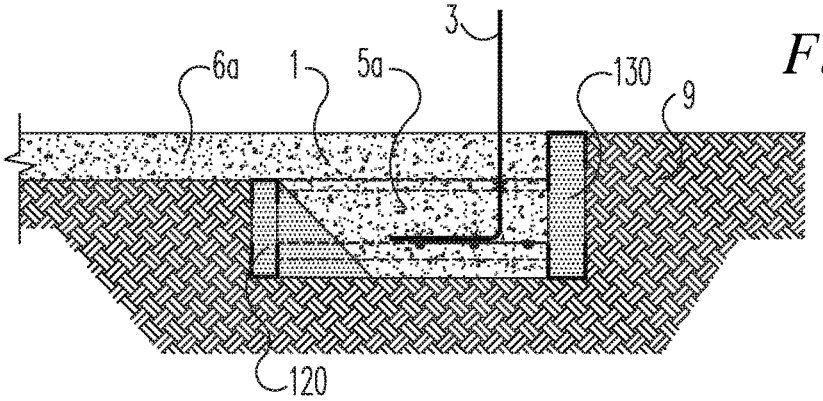

Then, a concrete paste 1 is poured into the space between the inner and outer form boards 120, 130, and poured over the inner form boards 120 and in the area for the concrete slab, see FIG. 20D. The concrete is poured to a height at which the top of the monolithic footing 5*a* and concrete slab 6*a* formed is in flush with the top of the outer form boards 130. Then, the concrete is fully cured in the footing form assembly 100 and over the inner form boards 120 to form a monolithic concrete footing 5*a*. The footing form assembly 100 becomes an integral part of the monolithic concrete footing 5*a* formed.

As further shown in FIG. 20E, vertical rebars 3' for construction of walls of the building are placed on top of the monolithic concrete footing 5*a* and are attached to the portions of vertical dowel rebars 3 protruded from the top of the monolithic concrete footing 5*a*. Then, a wall 7*a* is constructed on the monolithic concrete footing 5*a*, see FIG. 20F.

As further illustrated in FIG. 20G, similar to the concrete spread footing constructed using the stay-in-place footing form assembly 10, the lateral impact force of an earthquake is at least partially absorbed by the inner or outer form boards of the stay-in-place footing form assembly 100, which reduces the extent of the impact to the monolithic concrete footing of the building.

Figure 21G:
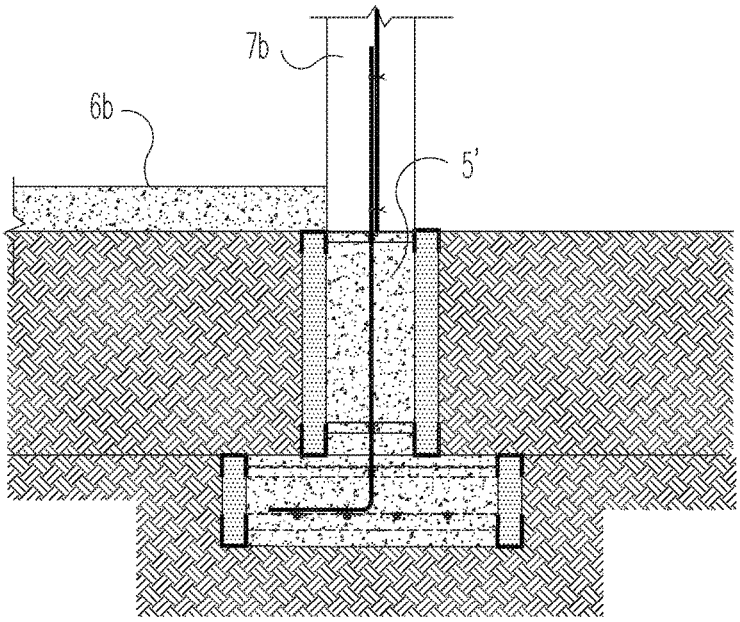

FIGS. 21A-21G further illustrate schematically construction of a concrete stem wall footing using the stay-in-place stem wall footing form subassembly 200 described above. In construction of a concrete stem wall footing, the same process of constructing a concrete spread footing 5 using footing form assembly 10 as described above in reference to FIGS. 19A-19E can be used to form the concrete footing 5 first. FIG. 21A shows a concrete footing 5 described above, a stem wall footing form subassembly 200 is installed on top of the concrete footing 5, as shown in FIG. 21B.

The stem wall footing form subassembly 200 is constructed in a similar manner of constructing the footing form assembly 10 described above. In installing stem wall footing form subassembly 200, the stem wall spacing rails 260, 270 are connected to inner and outer stem wall joining brackets 240*b*, 250*b* at the bottom and 240*a*, 250*a* at the top, respectively. In the installed stem wall footing form subassembly, both vertical rebar receptacles 266, 276 on the stem wall spacing rails 260, 270 are aligned with the second rebar receptacle on the upper spacing rail 70 of the footing assembly 10. Therefore, the vertical portion of each vertical dowel rebar 3 protruded from the concrete footing 5 is placed into vertical rebar receptacles 266, 276 of the stem wall spacing rails 260, 270, and may be further secured by fasten means described above. Before or during further securing vertical dowel rebars 3 to the stem wall spacing rails, soil 9 is filled around the perimeter of the installed stem wall footing form subassembly 200, see FIG. 21C.

Then, a concrete paste 1 is poured into the space within the assembled stem wall footing form subassembly 200. The concrete is fully cured within the stem wall footing form subassembly, and the stem wall footing form subassembly becomes an integral part of the concrete stem wall footing 5' formed, see FIG. 21D.

As further shown in FIG. 21E, vertical rebars 3' for construction of walls of the building are placed on top of the concrete stem wall footing 5' and are attached to the portions of vertical dowel rebars 3 protruded from the top of the concrete stem wall footing 5'. After a wall 7*b* is constructed as shown in FIG. 21F, a concrete paste is poured in the area inside the wall 7*b* and over the inner stem wall form boards 220 in the concrete stem wall footing 5' to form a concrete slab 6*b* of the building, see FIG. 21G.

Figure 21H:
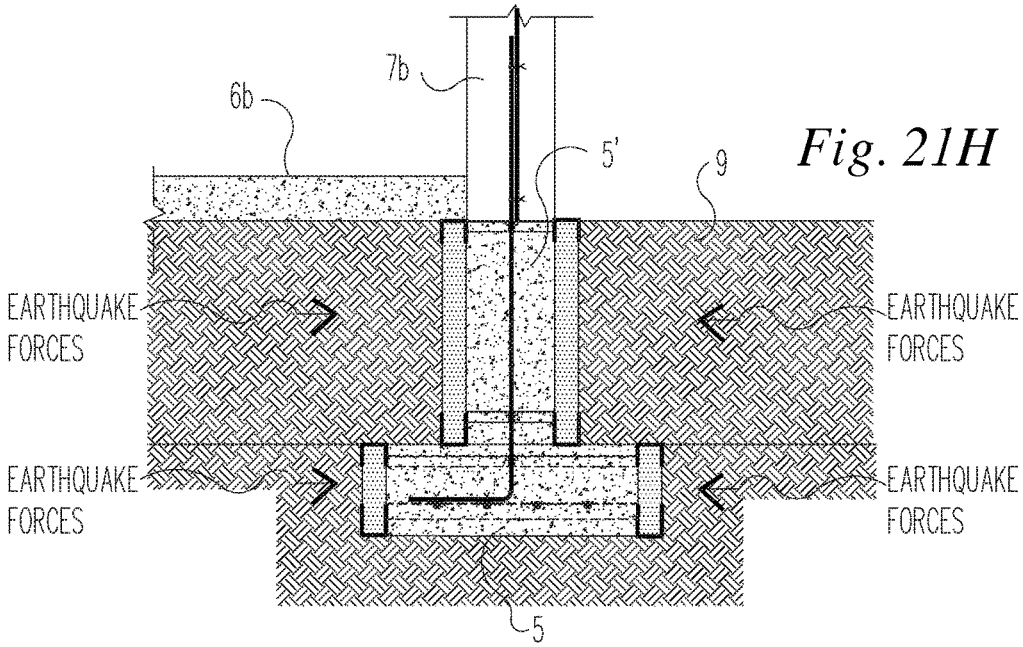
FIG. 21H further illustrates a built-in resistance to earthquake forces in an integral concrete stem wall footing formed with such a stay-in-place stem wall footing form subassembly.

As further illustrated in FIG. 21H, the inner and outer form boards 20, 30 in the stay-in-place footing form 10 and the inner and outer stem wall form boards 220, 230 in the stay-in-place stem wall footing form subassembly 200 absorb at least portions of the lateral force from an earthquake, which reduces the extent of the impact to the concrete stem wall footing of the building.

The stay-in-place footing form assembly of the present invention have various advantages. In one aspect, separate top and base brackets in the inner and outer joining brackets and separate spacing rails provide tremendous flexibility in implementing different architecture designs, manufacturing of the components, and job site installation of the footing form assembly. As described above, the same inner or outer joining brackets can be used for concrete footings of different depths and different widths, and for the inner and outer form boards of same thickness, the inner and outer joining brackets are interchangeable. Moreover, regardless the extent of difference in length between the inner and outer form boards and the frequency of occurrence of length differences, a pair of inner or outer joining brackets can be conveniently installed to join two boards at their interface, and another pair can be installed on the corresponding opposing side to facilitate installation of the spacing rails therebetween. Furthermore, additional joining brackets can be installed along the form boards at locations where additional structural strength or additional supports for rebars are needed. Such adaptability and convenience reduce component adjustment time and an overall construction time of the footing form at the construction site, which substantially reduces overall project costs. In addition, structural simplicities of individual components reduce manufacturing and other associated costs, for example fewer and less complex molds for manufacturing, and less inventory of different components for construction of footings of different sizes.

On the other hand, as described above connections of individual components of the instant footing form assemblies in constructing a footing form are simple and convenient, which does not require tying, bolting, screwing, or tightening. For example, to join the inner or outer form boards along the trench, the workers only need to insert the form boards into respective joining brackets; and to connect the lower and upper spacing rails, the workers only need to insert the spacing rails into the receptacles of respective base and top brackets. Therefore, the structural features of the components in the instant footing form assemblies enable a fast process in constructing the footing forms, which reduces labor and overall project costs.

Moreover, as a stay-in-place footing form assembly, the form boards will not be removed after pouring the concrete paste, which eliminates the challenge of timely removal of all form boards and supporting structures before the concrete is fully cured, as required by the existing concrete footing construction processes. In addition, during installation of rebars, reposition of soil to fill the trench can be accomplished at the same time. These are particularly advantageous in terms of a significant saving of labor costs and reduction of project time.

Importantly, the instant stay-in-place footing form assembly has multiple functionalities. It not only enables construction of various types of concrete footings, as a built-in structure of a concrete footing, it also enhances impact resistance of a building to earthquake impact forces, as well as enhances thermal resistance of a building to the surroundings. With insulation materials such as insulation foam boards described above, the concrete footing formed is an integral insulated concrete footing. The insulation foam boards form a barrier to protect the concrete footing on its lateral sides from a direct exposure to the surrounding soils. With an appropriate thickness of the insulation foam boards in consideration of a required absorbing capacity to the impact forces of earthquakes, the concrete footings constructed with the instant stay-in-place footing form assemblies have a built-in capacity to reduce the earthquake impacts to the building, as illustrated in FIGS. 19I, 20G and 21H.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

What is claimed is:

1. A stay-in-place footing form assembly comprising:

a plurality of inner form boards, each having a top, a bottom and a first end section and an opposing second end section, the inner form boards aligned in series with the first end section and the second end section of two immediately adjacent inner form boards against each other;

a plurality of outer form boards, each having a top, a bottom and a first end section and an opposing second end section, the outer form boards aligned in series with the first end section and the second end section of two immediately adjacent outer form boards against each other;

a plurality of pairs of inner joining brackets, each pair comprising a top bracket and a base bracket structurally independent of each other, the top bracket having an open lower end and the base bracket having an open upper end, and each top and base bracket having two opposing flanges with an inner width in mating relationship with a predetermined thickness of the first and second end sections of the inner form boards; each pair of the inner joining brackets disposed at an interface between two immediately adjacent inner form boards and joining the top and the bottom, respectively, of the two immediately adjacent inner form boards at the interface, each pair inner joining bracket disposed at the interface being separate and distanced from other inner joining brackets;

a plurality of pairs of outer joining brackets, each pair comprising a top bracket and a base bracket structurally independent of each other, the top bracket having an open lower end and the base bracket having an open upper end, and each top and base bracket having two opposing flanges with an outer width in mating relationship with a predetermined thickness of the first and second end sections of the outer form boards; each pair of the outer joining brackets disposed at an interface between two immediately adjacent outer form boards and joining the top and the bottom, respectively, of the two immediately adjacent outer form boards at the interface, each pair outer joining bracket disposed at the interface being separate and distanced from other outer joining brackets;

a plurality of lower spacing rails with a predetermined length, each lower spacing rail disposed between and connecting the base brackets in the inner and outer joining brackets aligned laterally, and each lower spacing rail comprising one or more first rebar receptacles, each first rebar receptacle in a form of recess from an upper edge of the lower spacing rail configured to hold a horizontal reinforcement bar used in a concrete footing; and a plurality of upper spacing rails with a predetermined length, each upper spacing rail disposed between and connecting the top brackets in the inner and outer joining brackets aligned laterally, and each upper spacing rail comprising one or more second rebar receptacles, each second rebar receptacle in a form of recess on a side of the upper spacing rail configured to hold a vertical reinforcement bar used in the concrete footing.

2. The stay-in-place footing form assembly of claim 1, wherein each of the top and base brackets comprises a rail receptacle on one of the flanges facing the spacing rails, configured to anchor an end of a respective spacing rail therein.

3. The stay-in-place footing form assembly of claim 2, wherein two opposing ends of each lower spacing rail are anchored in the rail receptacles of the base brackets of the inner and outer joining brackets aligned laterally, and two opposing ends of each upper spacing rail are anchored in the rail receptacles of the top brackets of the inner and outer joining brackets aligned laterally.

4. The stay-in-place footing form assembly of claim 1, wherein the lower spacing rails have a cross section of generally rectangular, and have a height to width ratio above 1.5 configured to withstand walking and standing of construction workers on the lower spacing rails during construction of the concrete footing.

5. The stay-in-place footing form assembly of claim 1, wherein the first rebar receptacle of the lower spacing rails has a minimum distance (D), in a vertical direction, of no less than 3 inches from a bottom of the first rebar receptacle to a bottom of the base brackets of the inner and outer joining brackets.

6. The stay-in-place footing form assembly of claim 1, wherein the first rebar receptacle of the lower spacing rails further comprises a pair of upper protrusions extending radially outward from the recess on the upper edge of the lower spacing rail configured to provide an enlarged opening to the first rebar receptacle to facilitate placement of the horizontal reinforcement bar into the first rebar receptacle.

7. The stay-in-place footing form assembly of claim 1, wherein the second rebar receptacle of the upper spacing rails further comprises a pair of protrusions extending radially outward from the recess on the side of the upper spacing rail configured to provide an enlarged opening to the second rebar receptacle to facilitate placement of the vertical reinforcement bar into the second rebar receptacle.

8. The stay-in-place footing form assembly of claim 1, wherein two opposing ends of each upper spacing rail are integrally connected with two top brackets, and two opposing ends of each lower spacing rail are integrally connected with two base brackets.

9. The stay-in-place footing form assembly of claim 1 further comprising the top and base brackets of the inner joining brackets inserted on the top and bottom of the inner form boards, respectively, beyond the interface between two inner form boards, the top and base brackets of the outer joining brackets inserted on the top and bottom of the outer form boards, respectively, beyond the interface between two outer form boards, and the lower and upper spacing rails connecting the top and base brackets, respectively, of the inner and outer joining brackets aligned laterally.

10. The stay-in-place footing form assembly of claim 1, wherein the inner form boards and the outer form boards have a same height.

11. The stay-in-place footing form assembly of claim 1, wherein a height of the inner form boards is less than a height of the outer form boards.

12. The stay-in-place footing form assembly of claim 1, wherein the inner and outer form boards are insulation foam boards.

13. The stay-in-place footing form assembly of claim 12, wherein the outer form boards have a rectangular cross section having the predetermined thickness of the first and second end sections.

14. The stay-in-place footing form assembly of claim 12, wherein the first and second end sections of the inner form boards have a rectangular cross section with the predetermined thickness.

15. The stay-in-place footing form assembly of claim 14, wherein each of the inner form boards further comprises one or more extended inner mid-section having a triangular cross section with a planar base.

16. The stay-in-place footing form assembly of claim 1 further comprising a plurality of free standing insulation foam boards, aligned in series along an external side of the outer form boards configured to enhance absorbing capacity of impact force of earthquakes by the stay-in-place footing form assembly in the concrete footing.

17. The stay-in-place footing form assembly of claim 1 further comprising a plurality of inner corner anchors and outer corner anchors, each corner anchor comprising a top corner bracket and a base corner bracket, each corner bracket having a first and a second bracket portion with an angle between each other, and each bracket portion having an inner flange and an outer flange with an inner width between the flanges in mating relationship with the predetermined thickness of the first and second end sections of corresponding form boards.

18. The stay-in-place footing form assembly of claim 17, wherein each first and second bracket portion comprises a rail receptacle on one of the flanges facing an inside of the footing form assembly, configured to anchor an end of a respective spacing rail therein.

19. The stay-in-place footing form assembly of claim 17, wherein two opposing ends of the lower spacing rails are anchored in the rail receptacles on the first and second bracket portions of corresponding base corner brackets, and two opposing ends of the upper spacing rails are anchored in the rail receptacles on the first and second bracket portions of corresponding top corner brackets.

20. The stay-in-place footing form assembly of claim 1 further comprising a stay-in-place stem wall footing form subassembly, the stem wall footing form subassembly comprising:

a plurality of inner stem wall form boards, each having a top, a bottom and a first end section and an opposing second end section, the inner stem wall form boards aligned in series with the first end section and the second end section of two immediately adjacent inner stem wall form boards against each other;

a plurality of outer stem wall form boards, each having a top, a bottom and a first end section and an opposing second end section, the outer stem wall form boards aligned in series with the first end section and the second end section of two immediately adjacent outer stem wall form boards against each other;

a plurality of pairs of inner stem wall joining brackets, each pair comprising a top bracket and a base bracket structurally independent of each other, the top bracket having an open lower end and the base bracket having an open upper end, and each top and base bracket having two opposing flanges with an inner width in mating relationship with a predetermined thickness of the inner stem wall form boards; the inner stem wall joining brackets joining the top and the bottom, respectively, of two inner stem wall form boards at an interface between the two inner stem wall form boards;

a plurality of pairs of outer stem wall joining brackets, each pair comprising a top bracket and a base bracket structurally independent of each other, the top bracket having an open lower end and the base bracket having an open upper end, and each top and base bracket having two opposing flanges with an inner width in mating relationship with a predetermined thickness of the outer stem wall form boards; the outer stem wall joining brackets joining the top and the bottom, respectively, of two outer stem wall form boards at an interface between the two outer stem wall form boards; and a plurality of upper and lower stem wall spacing rails with a predetermined length, disposed between and connecting the top and the base brackets, respectively, of the inner and outer stem wall joining brackets aligned laterally, and each upper and lower spacing rail comprising one or more vertical rebar receptacles.

21. The stay-in-place footing form assembly of claim 20, wherein the one or more vertical rebar receptacles of the upper and lower stem wall spacing rails are aligned with the second rebar receptacles of the upper spacing rails of the stay-in-place footing form assembly.

22. The stay-in-place footing form assembly of claim 21, wherein the stay-in-place stem wall footing form subassembly are disposed on top of a concrete footing formed with the stay-in-place footing form assembly.

23. The stay-in-place footing form assembly of claim 22, wherein a plurality of the vertical reinforcement bar extended from the concrete footing are situated in the vertical rebar receptacles of the upper and lower stem wall spacing rails.

24. A method of constructing a concrete footing using a stay-in-place footing form assembly, said stay-in-place footing form assembly comprising:

a plurality of inner form boards, each having a top, a bottom and a first end section and an opposing second end section, the inner form boards aligned in series with the first end section and the second end section of two immediately adjacent inner form boards against each other;

a plurality of outer form boards, each having a top, a bottom and a first end section and an opposing second end section, the outer form boards aligned in series with the first end section and the second end section of two immediately adjacent outer form boards against each other;

a plurality of pairs of inner joining brackets, each pair comprising a top bracket and a base bracket structurally independent of each other, the top bracket having an open lower end and the base bracket having an open upper end, and each top and base bracket having two opposing flanges with an inner width in mating relationship with a predetermined thickness of the first and second end sections of the inner form boards;

each pair of the inner joining brackets disposed at an interface between two immediately adjacent inner form boards and joining the top and the bottom, respectively, of the two immediately adjacent inner form boards at the interface, each pair inner joining bracket disposed at the interface being separate and distanced from other inner joining brackets;

a plurality of pairs of outer joining brackets, each pair comprising a top bracket and a base bracket structurally independent of each other, the top bracket having an open lower end and the base bracket having an open upper end, and each top and base bracket having two opposing flanges with an outer width in mating relationship with a predetermined thickness of the first and second end sections of the outer form boards; each pair of the outer joining brackets disposed at an interface between two immediately adjacent outer form boards and joining the top and the bottom, respectively, of the two immediately adjacent outer form boards at the interface, each pair outer joining bracket disposed at the interface being separate and distanced from other outer joining brackets;

a plurality of lower spacing rails with a predetermined length, each lower spacing rail disposed between and connecting the base brackets in the inner and outer joining brackets aligned laterally, and each lower spacing rail comprising one or more first rebar receptacles, each first rebar receptacle in a form of recess from an upper edge of the lower spacing rail configured to hold a horizontal reinforcement bar used in the concrete footing; and a plurality of upper spacing rails with a predetermined length, each upper spacing rail disposed between and connecting the top brackets in the inner and outer joining brackets aligned laterally, and each upper spacing rail comprising one or more second rebar receptacles, each second rebar receptacle in a form of recess on a side of the upper spacing rail configured to hold a vertical reinforcement bar used in the concrete footing;

the method comprising:

(a) in a trench excavated for the concrete footing, joining the inner form boards in series using the plurality of the inner joining brackets, joining the plurality of outer form boards in series using the outer joining brackets, and connecting the lower spacing rails between the base brackets in the inner and outer joining brackets aligned laterally;

(b) placing a plurality of the horizontal reinforcement bar into the first rebar receptacles on the lower spacing rails;

(c) connecting the upper spacing rails between the top brackets in the inner and outer joining brackets aligned laterally;

(d) placing a plurality of the vertical reinforcement bar into the second rebar receptacles of the upper spacing rails;

(e) repositioning soil to fill the trench around the stay-in-place footing form assembly; and (f) pouring a concrete paste into the stay-in-place footing form assembly, and curing the concrete paste to form the concrete footing with the stay-in-place footing form assembly as an integral part of the concrete footing.

25. The method of claim 24, wherein a height of the inner form boards is less than a height of the outer form boards, and the concrete paste is poured over the top of the inner form boards to form a monolithic footing.

26. The method of claim 24, wherein the inner form boards and the outer form boards have a same height, and the concrete is poured to a height equal to the top of the inner and the outer form boards to form a spread concrete footing.

27. The method of claim 24 further comprising constructing a stem wall footing, wherein the method further comprises:

(g) constructing a stay-in-place stem wall footing form subassembly on the concrete footing, the stem wall footing form subassembly comprising:

a plurality of inner stem wall form boards, each having a top, a bottom and a first end section and an opposing second end section, the inner stem wall form boards aligned in series with the first end section and the second end section of two immediately adjacent inner stem wall form boards against each other;

a plurality of outer stem wall form boards, each having a top, a bottom and a first end section and an opposing second end section, the outer stem wall form boards aligned in series with the first end section and the second end section of two immediately adjacent outer stem wall form boards against each other;

a plurality of pairs of inner stem wall joining brackets, each pair comprising a top bracket and a base bracket structurally independent of each other, the top bracket having an open lower end and the base bracket having an open upper end, and each top and base bracket having two opposing flanges with an inner width in mating relationship with a predetermined thickness of the inner stem wall form boards; the inner stem wall joining brackets joining the top and the bottom, respectively, of two inner stem wall form boards at an interface between the two inner stem wall form boards;

a plurality of pairs of outer stem wall joining brackets, each pair comprising a top bracket and a base bracket structurally independent of each other, the top bracket having an open lower end and the base bracket having an open upper end, and each top and base bracket having two opposing flanges with an inner width in mating relationship with a predetermined thickness of the outer stem wall form boards; the outer stem wall joining brackets joining the top and the bottom, respectively, of two outer stem wall form boards at an interface between the two outer stem wall form boards; and a plurality of upper and lower stem wall spacing rails with a predetermined length, disposed between and connecting the top and the base brackets, respectively, in the inner and outer stem wall joining brackets aligned laterally, and each upper and lower spacing rail comprising one or more vertical rebar receptacles;

(h) placing each of the vertical reinforcement bars extending from the concrete footing into corresponding vertical rebar receptacles of the upper and lower stem wall spacing rails; and (i) pouring a concrete paste into the stay-in-place stem wall footing form subassembly, and curing the concrete paste to form the stem wall footing with the stay-in-place stem wall footing form subassembly as an integral part of the stem wall footing.

* * * * *